US011087731B2

(12) United States Patent
Baker

(10) Patent No.: US 11,087,731 B2
(45) Date of Patent: Aug. 10, 2021

(54) HUMBUCKING PAIR BUILDING BLOCK CIRCUIT FOR VIBRATIONAL SENSORS

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/985,863

(22) Filed: Aug. 5, 2020

(65) Prior Publication Data

US 2020/0365129 A1 Nov. 19, 2020

Related U.S. Application Data

(63) Continuation-in-part of application No. 16/139,027, filed on Sep. 22, 2018, now Pat. No. 10,380,986, and a continuation-in-part of application No. 15/616,396, filed on Jun. 7, 2017, now Pat. No. 10,217,450, and a continuation of application No. 16/156,509, filed on Oct. 10, 2018, now abandoned, and a continuation-in-part of application No. 14/338,373, filed on Jul. 23, 2014, now Pat. No. 9,401,134.

(51) Int. Cl.

| | |
|---|---|
| ***G10H 3/18*** | (2006.01) |
| ***G10H 3/22*** | (2006.01) |
| ***G10H 1/26*** | (2006.01) |
| ***G10H 1/46*** | (2006.01) |
| ***G10H 3/14*** | (2006.01) |
| ***G10H 1/34*** | (2006.01) |

(52) U.S. Cl.

CPC ..... *G10H 3/181* (2013.01); *G10H 1/26* (2013.01); *G10H 1/342* (2013.01); *G10H 1/46* (2013.01); *G10H 3/143* (2013.01); *G10H 3/185* (2013.01); *G10H 3/186* (2013.01); *G10H 3/188* (2013.01); *G10H 3/22* (2013.01); *G10H 2220/505* (2013.01); *G10H 2250/235* (2013.01)

(58) Field of Classification Search

CPC ..... G10H 3/12–3/22; G10H 3/181; G10H 3/188; G10H 1/26; G10H 1/46; G10H 3/185; G10H 3/143; G10H 3/186; G10H 1/342; G10H 2250/235; G10H 2220/505; G10H 2220/521; G10H 3/146

USPC ..... 84/723, 724, 726–728, 742, 743

See application file for complete search history.

(56) References Cited

U.S. PATENT DOCUMENTS

| | | | |
|---|---|---|---|
| 1,915,858 | A | 6/1933 | Miessner |
| 2,026,841 | A | 1/1936 | Lesti |
| 2,455,575 | A | 12/1948 | Fender |
| 2,557,754 | A | 6/1951 | Morrison |
| 2,896,491 | A | 7/1959 | Lover |
| 2,968,204 | A | 1/1961 | Fender |
| 2,976,755 | A | 3/1961 | Fender |
| 3,005,282 | A | 10/1961 | Christiansen |
| 3,916,751 | A | 11/1975 | Stich |

(Continued)

*Primary Examiner* — Jeffrey Donels

(57) ABSTRACT

This invention eliminates most mechanical switching in vibrational pickup circuits by using variable gains to combine signals of sensors in differential amplifiers as J–1 humbucking pairs for J>1 number of sensors, with the sensors matched to produce the same level and phase of unwanted hum from external sources. It can also combine J>1 number of matched sensors with K>1 number of dissimilar sensors which are matched only to each other in the same manner. This produces not only all the possible mechanically switched humbucking signals, but all the continuously-varying combinations of humbucking signals in between.

15 Claims, 13 Drawing Sheets

(56) References Cited

U.S. PATENT DOCUMENTS 4,175,462 A * 11/1979 Simon ..... G10H 3/182 84/602
4,305,320 A * 12/1981 Peavey ..... G10H 3/182 84/737
4,379,421 A 4/1983 Nunan
4,501,185 A 2/1985 Blucher
4,545,278 A 10/1985 Gagon
4,581,795 A 4/1986 Fender
4,581,975 A 4/1986 Fender
4,711,149 A * 12/1987 Starr ..... G10H 3/182 84/477 R
4,817,486 A * 4/1989 Saunders ..... G10H 1/24 84/725
5,136,919 A * 8/1992 Wolstein ..... G10H 1/08 84/735
5,189,241 A * 2/1993 Nakamura ..... G10H 3/181 84/728
5,292,998 A 3/1994 Knapp
5,311,806 A * 5/1994 Riboloff ..... G10H 3/182 84/728
5,763,808 A * 6/1998 Thomson ..... G10H 3/182 84/728
6,121,537 A * 9/2000 Pawar ..... G10H 3/182 84/728
6,316,713 B1 * 11/2001 Furst ..... G10H 1/0008 84/726
6,781,050 B2 * 8/2004 Olvera ..... G10H 3/182 84/453
6,888,057 B2 * 5/2005 Juszkiewicz ..... G10H 1/0058 84/645
7,276,657 B2 * 10/2007 Bro ..... G10H 1/18 84/723
7,999,171 B1 * 8/2011 Hamilton ..... G10H 3/182 84/727
8,479,143 B1 * 7/2013 Baeckler ..... G06F 30/327 716/135
8,704,074 B1 * 4/2014 Liu ..... G10H 3/22 84/728
9,196,235 B2 11/2015 Ball et al.
9,401,134 B2 6/2016 Baker
9,640,162 B2 * 5/2017 Ball ..... G10H 1/46
9,704,464 B1 * 7/2017 Petschulat ..... G10H 3/186
10,217,450 B2 2/2019 Baker
10,380,986 B2 8/2019 Baker
2003/0110508 A1 * 6/2003 Bridgelall ..... H04N 7/148 725/117
2003/0145715 A1 * 8/2003 Wnorowski ..... G10H 3/186 84/726
2004/0100944 A1 * 5/2004 Richmond ..... H04L 45/306 370/360
2004/0210575 A1 * 10/2004 Bean ..... G06K 9/00442
2005/0125756 A1 * 6/2005 Ditlow ..... G06F 30/392 716/124
2006/0011051 A1 * 1/2006 Aivbrosino ..... G10H 3/18 84/742
2006/0101340 A1 * 5/2006 Sridhar ..... H04L 41/12 715/734
2007/0251374 A1 * 11/2007 Armstrong-Muntner ..... G10H 3/182 84/735
2009/0308233 A1 * 12/2009 Jacob ..... G10H 1/18 84/726
2010/0124130 A1 * 5/2010 Oh ..... G11C 7/1066 365/193
2010/0208916 A1 * 8/2010 Jacob ..... G10H 3/186 381/104
2012/0024129 A1 * 2/2012 Ball ..... G10H 1/18 84/602
2012/0036983 A1 * 2/2012 Ambrosino ..... G10H 3/183 84/731
2013/0325899 A1 * 12/2013 Mohaban ..... G06F 16/148 707/791
2014/0150630 A1 * 6/2014 Juszkiewicz ..... G10H 1/44 84/626
2015/0262568 A1 * 9/2015 Krasnov ..... G10H 3/181 84/728
2016/0027422 A1 * 1/2016 Baker ..... G10H 3/22 84/726
2017/0228389 A1 * 8/2017 Mohaban ..... H04L 67/10
2019/0057679 A1 2/2019 Baker
2020/0234685 A1 7/2020 Baker

* cited by examiner

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

© 2018 don baker dba android originals LC

HUMBUCKING PAIR BUILDING BLOCK CIRCUIT FOR VIBRATIONAL SENSORS

This application claims the precedence of various elements in:
U.S. Pat. No. 10,380,986, granted Aug. 13, 2109, and
U.S. Pat. No. 10,217,450, granted Feb. 26, 2019, and
U.S. Non-Provisional patent application Ser. No. 16/156,509, filed Oct. 10, 2018, and
U.S. Provisional Patent Application No. 62/599,452, filed 2017 Dec. 15, and
U.S. Provisional Patent Application No. 62/574,705, filed 2017 Oct. 19, and
U.S. Pat. No. 9,401,134B2, filed 2014 Jul. 23, granted 2016 Jul. 26,
by this inventor, Donald L. Baker dba android originals LC, Tulsa Okla. USA.

COPYRIGHT AUTHORIZATION

The entirety of this application, specification, claims, abstract, drawings, tables, formulae etc., is protected by copyright: © 2018-2020 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

None requested

CROSS-REFERENCE TO RELATED APPLICATIONS

This application is related to the use of matched single-coil electromagnetic pickups, as related in the applications cited above, and Non-Provisional patent application Ser. No. 16/812,870, filed 9 Mar. 2020; Non-Provisional patent application Ser. No. 16/752,670, filed 26 Jan. 2020; and Non-Provisional patent application Ser. No. 15/917,389, dated Jul. 14, 2018, by this inventor, Donald L. Baker dba android originals LC, Tulsa Okla. USA.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

This application is a restatement of Non-Provisional patent application Ser. No. 16/156,509, falsely declared abandoned by Patent Examiner Daniel Swerdlow, on Jan. 17, 2020, after having been falsely and speciously rejected by Examiner Swerdlow on May 22, 2019. It is currently subject to a lawsuit making its way through the Federal Court system, charging violations of Federal Law and regulation outside the Patent Code, including 18 USC 242, 18 USC 1001 and Federal Civil Service Regulations. Mr. Baker filed Case No. 19-CV-289-CVE-FHM in U.S. District Court for the Northern District of Oklahoma on May 28, 2019, regarding Non-Provisional patent application Ser. No. 15/197,389. Mr. Baker added Mr. Swerdlow to the Complaint as a Defendant in a Motion filed Jul. 26, 2019, after his Advisory Action of Jun. 25, 2019. The U.S. District Court dismissed the complaint on Oct. 22, 2019. Mr. Baker appealed this dismissal to the U.S. Court of Appeals for the Tenth Circuit in a filing of Nov. 17, 2019, which the Tenth Circuit dismissed on Jun. 17, 2020. Mr. Baker is currently writing a Petition for a Writ of Certeriorari to the Supreme Court of the United States, appealing both dismissals as failing to properly advise him on or consider the violations of law outside the Patent Code. If necessary, Mr. Baker will correct any errors in procedure that the District Court cited, and refile the case.

In the meantime, Mr. Baker has filed descriptions of Non-Provisional patent application Ser. No. 16/156,509 in his Project pages on ResearchGate.net, https://www.researchgate.net/project/US-patent-application-16-156-509-Obtaining-humbucking-tones-with-variable-gains, and in 2020 Springer-Nature published his book, Sensor Circuits and Switching for Stringed Instruments; Humbucking Pairs, Triples, Quads and Beyond, ISBN 978-3-030-23123-1, currently being sold by Springer and Amazon.com. Chapter 11 of this work discusses Non-Provisional patent application Ser. No. 16/156,509 in depth. Mr. Baker regards using a specious examination to force an application to the added time and expense of a PTAB appeal, as deliberate extortion for more money, especially including the Office Communication of Jun. 24, 2020 which demands yet another $1000 on top of the $200 (2 Feb. 2020) already paid for a petition on Ser. No. 16/156,509.

This application rewrites the Claims of Ser. No. 16/156,509 to address any non-specious concerns that Mr. Swerdlow expressed, and which Mr. Swerdlow flatly refused to consider or correct in his haste to spike the application. It also adds as small amount of new material, which justifies a new application. Any attempt to deny Mr. Baker his legitimate rights to protect his intellectual property will result in an immediate lawsuit charging violations of US Code, Civil Service Regulations and ethics outside of the Patent Code. There is no excuse for this kind of abusive and illegal behavior at the USPTO, which would result in charges of Federal felonies for any of us outside the Government. Mr. Baker, who has been a GS-rating in several U.S. Departments, thinks that in an honest Agency or Department it would be a firing offense to cheat customers in these manners—at the very least, "conduct unbecoming the Service".

Mr. Baker never "abandoned" Non-Provisional patent application Ser. No. 16/156,509; he simply chose to prosecute it by other means, through the Federal Court system. The USPTO had demonstrated conclusively in Non-Provisional patent application Ser. No. 15/917,389 that it neither could nor would hold its patent examiners responsible for honest and ethical treatment of applicants. It allowed that patent examiner to falsify prior art, inventing claim language for prior which does not exist, in order to arbitrarily and capriciously reject Mr. Baker's Claims in Ser. No. 15/917, 389. Then it whitewashed the fraud by subverting the 181 complaint system, effectively absolving the falsification of prior art as being within Office procedure. Thus, it admitted that it regularly falsifies examinations and its own complaint processes, which violates Federal law and regulations outside the Patent Code, and cheats customers. Given this level of arbitrary and capricious corruption embedded so deeply in the Patent Office culture, one might be forgiven for doubting the honesty and integrity of the Patent Trial and Appeal Board, made up of former patent examiners.

The patent examiner assigned to Ser. No. 16/156,509 refused to help Mr. Baker refine his Claims on rather complex and innovative material, as required by the MPEP, and concocted objections to Mr. Baker's claim language, based not on the engineering definitions or the intent of the Claims, but upon specious and picayune interpretations of "appropriate" language. Therefore, Mr. Baker could only conclude that this examiner was following the previous examiner's policy of spiking Mr. Baker's applications by any means necessary, quite possibly in retaliation for previous complaints against a previous examiner. Which prompted the filing of a lawsuit in U.S. District Court, charging violations of law and regulation outside the Patent Code, especially the felony falsification of Federal paperwork and the felony deprivation of civil liberties under the color of law.

This is the result not of Mr. Baker failing to prosecute his application, but of the USPTO making a habit of cheating its own paying customers. Should the USPTO now claim that Mr. Baker cannot file this application because he legitimately disclosed the invention in public while the USPTO was deliberately sabotaging it, as it did a previous application, the USPTO compounds its own felonious misbehavior. So shall Mr. Baker charge in any next Federal lawsuit which may result from continued obstruction, plus a request that any Court ruling in his favor Order: 1) the USPTO official and agents involved to pay Mr. Baker damages for all the extra and unnecessary fees he has and will pay; and 2) that any such officials and agents be investigated for indictment under the RICO Act.

Your paying customers generally want no more that what they have earned by their own hard work. And most are quite willing to learn how to do better. But when you deliberately deny and destroy a person's best work in years on sheer malicious whims, you deserve to be called out in public.

TECHNICAL FIELD

This invention primarily describes humbucking circuits of vibration sensors primarily using variable gains in active circuits instead of electromechanical or analog-digital switching. It works for sensors which have matched impedances and responses to external interfering signals, known as hum. The sensors may also and preferably have diametrically reversed or reversible phase responses to vibration signals. It is directed primarily at musical instruments, such as electric guitars and pianos, which have vibrating ferromagnetic strings and electromagnetic pickups with magnets, coils and poles, but can apply to any vibration sensor which meets the functional requirements, on any other instrument in any other application. Other examples might be piezoelectric sensors on wind and percussion instruments, or differential combinations of vibration sensors used in geology, civil engineering, architecture or art.

Background and Prior Art

Single-Coil Pickups

Early electromagnetic pickups, such as U.S. Pat. No. 1,915,858 (Miessner, 1933) could have any number of coils, or one coil, as in U.S. Pat. No. 2,455,575 (Fender & Kaufmann, 1948). The first modern and lasting single-coil pickup design, with a pole for each string surrounded by a single coil, seems to be U.S. Pat. No. 2,557,754 (Morrison, 1951), followed by U.S. Pat. No. 2,968,204 (Fender, 1961). This has been followed by many improvements and variations. In all those designs, starting with Morrison's, the magnetic pole presented to the strings is fixed.

Dual-Coil Humbuckers

Dual-coil humbucking pickups generally have coils of equal matched turns around magnetic pole pieces presenting opposite magnetic polarities towards the strings. Lesti, U.S. Pat. No. 2,026,841, 1936, perhaps the first humbucking pickup, had multiple poles, each with a separate coil. Lover, U.S. Pat. No. 2,896,491, 1959, had a single magnet providing the fields for two sets of poles, one for each string, with a coil around each set, the pickup design which most modern humbuckers use. These have been followed by a great many improvements and variations, including: Fender, U.S. Pat. No. 2,976,755, 1961; Stich, U.S. Pat. No. 3,916,751, 1975; Blucher, U.S. Pat. No. 4,501,185, 1985; and Knapp, U.S. Pat. No. 5,292,998, 1994;

Humbucking Pairs

Nunan, U.S. Pat. No. 4,379,421, 1983, patented a reversible pickup that could present either pole to the strings. But the patent only mentions rotating the middle pickup of three to produce two humbucking pairs with the neck and bridge pickups, using a 5-way switching system. It does not present a humbucking pair made with the neck and bridge pickups. Fender, U.S. Pat. No. 4,581,975, 1986, may be the first to use the term "humbucking pairs" (column 2, line 31), stating in column 2, line 19, "Thus, it is common for electrical musical instruments to have two, four or six pick-ups." Yet, in the 3-coil arrangement of his patent, with the middle pickup presenting North poles to the strings and the neck and bridge pickups presenting South poles to the strings, he did not combine the signals from those pickups to form humbucking pairs. Instead, he added dummy pickups between them, underneath the pick guard (FIG. 2), without magnetic poles, for provide the hum signals for cancellation.

Commonly manufactured single-coil pickups are not necessarily matched. Different numbers of turns, different sizes of wires, and different sizes and types of poles and magnets produce differences in both the hum signal and in the relative phases of string signals. On one 3-coil Fender Stratocaster™, for example, the middle and neck coils were reasonably similar in construction and could be balanced. But the bridge coil was hotter, having a slightly different structure to provide a stronger signal from the smaller vibration of the strings near the bridge. Thus in one experiment, even balancing the turns as closely as possible produced a signal with phase differences to the other two pickups, due to differences in coil impedance.

Electro-Mechanical Guitar Pickup Switching

The standard 5-way switch (Gagon & Cox, U.S. Pat. No. 4,545,278, 1985) on an electric guitar with 3 single-coil pickups typically provides to the output: the neck coil, the neck and middle coils in parallel, the middle coil, the middle and bridge coils in parallel, and the bridge coil. Typically, the middle pickup has the opposite pole up from the other two, making the parallel connections at least partially humbucking. But while the middle and neck coils have roughly equal numbers of turns, and the bridge coil has more turns than the other two to produce a roughly equal signal from the smaller physical vibrations of the strings nearer the bridge. The standard 3-way switch on a dual-humbucker guitar typically produces the neck, neck||bridge and bridge pickups at the output, all of which are humbucking. These two switches are "standards" because the vast majority of electric guitars on the market use them.

Microcontrollers in Guitar Pickup Switching

Ball, et al. (US2012/0024129A1; U.S. Pat. No. 9,196,235, 2015; U.S. Pat. No. 9,640,162, 2017) describe a "Microprocessor" controlling a "digitally controlled analog switching matrix", presumably one or more solid-state cross-point switches, though that is not explicitly stated, with a wide number of pickups, preamps and controls hung onto those two boxes without much specification as to how the individual parts are connected together to function. According to the Specification, everything, pickups, controls, outputs and displays (if any), passes through the "switching matrix". If this is comprised of just one cross-point switching chip, this may present the problem of inputs and outputs being interrupted by queries to the controls. In the Specification, the patent cites the ability to make "any combination of combinations" without describing or providing a figure any specific one, or even providing a table or scheme describing the set. It states, "On board controls are similar to or exactly the same as conventional guitar/bass controls." But there is not enough information in the patent for someone "with ordinary skill in the art" to either construct or fully evaluate the invention.

The Ball patents make no mention or claim of any connections to produce humbucking combinations. The flow chart, as presented, could just as well be describing analog-digital controls for a radio, or record player or MPEG device. In later marketing (https://www.music-man.com/instruments/guitars/the-game-changer), the company has claimed "over 250,000 pickup combinations" without demonstration or proof, implying that it could be done with 5 coils (from 2 dual-coil humbuckers and 1 single-coil pickup).

Bro and Super, U.S. Pat. No. 7,276,657B2, 2007, uses a micro-controller to drive a switch matrix of electro-mechanical relay switches, in preference to solid-state switches. The specification describes 7 switch states for each of 2 dual-coil humbuckers, the coils designated as 1 and 2: 1, 2, 1+2 (meaning connected in series), 1-2 (in series, out-of-phase), 1||2 (parallel, in-phase), 1||(−2) (parallel, out-of-phase), 0 (no connection, null output). In Table 1, the same switch states are applied to 2 humbuckers, designated neck and bridge. That is three 7-way switches, for a total number of combinations of $7^3$=343, some of which are duplicates and null outputs Table 1 in Bro and Super cites 157 combinations, of which one is labeled a null output. For 4 coils, the table labeled Math 12b in Baker, U.S. Pat. No. 10,217,450 (2019), identifies 620 different combinations of 4 coils, from 69 distinct circuit topologies containing 1, 2, 3 and 4 coils, including variations due to the reversals of coil terminals and the placement of coils in different positions in a circuit.

Developments by Baker

U.S. Pat. No. 9,401,134B2, Filed 2014 Jul. 23, Granted 2016 Jul. 26, Acoustic-Electric Stringed Instrument with Improved Body, Electric Pickup Placement, Pickup Switching and Electronic Circuit An electric-acoustic stringed instrument has a removable, adjustable and acoustic artwork top with a decorative bridge and tailpiece; a mounting system for electric string vibration pickups that allows five degrees of freedom in placement and orientation of each pickup anyplace between the neck and bridge; a pickup switching system that provides K*(K−1)/2 series-connected and K*(K−1)/2 parallel-connected humbucking circuits for K matched single-coil pickups; and an on-board preamplifier and distortion circuit, running for over 100 hours on two AA cells, that provides control over second- and third-harmonic distortion. The switched pickups, and up to M=12 switched tone capacitors provides up to M*K*(K−1) tonal options, plus a linear combination of linear, near second-harmonic and near-third harmonic signals, preamp settings, and possible additional vibration sensors in or on the acoustic top.

PPA 62/355,852, 2016 Jun. 28, Switching System for Paired Sensors with Differential Outputs, Especially Matched Single Coil Electromagnetic Pickups in Stringed Instruments The PPA 62/355,852 looked at what would happen to humbucking pair choices with different distributions of four matched pickups between the neck and bridge. U.S. Pat. No. 9,401,134 used a (N,N,S,S) configuration from neck to bridge (FIG. 12), where N indicates a North-up pickup, and S indicates a South-up pickup. This PPA considered the in choices of in-phase and contra-phase humbucking pairs for (N,S,S,N), (N,S,N,N) and (N,N,N,N).

PPA 62/370,197, 2016 Aug. 2, A Switching and Tone Control System for a Stringed Instrument with Two or More Dual-Coil Humbucking Pickups, and Four or More Matched Single-Coil Pickups The PPA 62/370,197 considered a 6-way 4P6T switching system for two humbuckers, with gain resistors for each switch position. Adding series-parallel switching for the humbucker internal coils increased the number of switching states to 24, of which 4 produced duplicate circuits. Concatenated switches were considered to extend 6-way switching to any number of pickups. The PPA also considered digitally-controlled analog cross-point switches driven by a manual shift control and ROM sequencer, with gain adjustments to a differential preamp. Then a micro-controller to drive the ROM sequencer, with swipe and tap controls, a user display. It included an A/D converter to take samples from the output of the preamp, run Fast Fourier Transforms (FFTs) on the outputs, and use statistical measures of the spectra to set gain in the preamp and the order of switching, to equalize the outputs and order the order of switching from warm to bright and back. The PPA predicted large numbers of possible circuits for humbucking pairs and quads, and anticipated the limitations of mechanical switches.

Non-Provisional patent application Ser. No. 15/616,396, 2017 Jun. 7, Humbucking Switching Arrangements and Methods for Stringed Instrument Pickups, Granted as U.S. Pat. No. 10,217,450, 2019 Feb. 26

This invention develops the math and topology necessary to determine the potential number of tonally distinct connections of sensors, musical vibration sensors in particular. It claims the methods and sensor topological circuit combinations, including phase reversals from inverting sensor connections, up to any arbitrary number of sensors, excepting those already patented or in use. It distinguishes which of those sensor topological circuit combinations are humbucking for electromagnetic pickups. It presents a micro-controller system driving a crosspoint switch, with a simplified human interface, which allows a shift from bright to warm tones and back, particularly for humbucking outputs, without the user needing to know which pickups are used in what combinations. It suggests the limits of mechanical switches and develops a pickup switching system for dual-coil humbucking pickups.

PPA 62/555,487, 2017 Junn. 20, Single-Coil Pickup with Reversible Magnet & Pole Sensor Previous patent applications from this inventor addressed the development of switching systems for humbucking pairs (especially of electromagnetic guitar pickups), quads, hexes, octets and up, as well as a system for placing pickups in any position, height and orientation between the bridge and neck of a stringed instrument. Non-Provisional patent application Ser. No. 15/616,396 makes clear that any electronic switching system for electromagnetic sensors must know which pole is up on each pickup in order to achieve humbucking results. For such pickups, changing the poles and order of poles between the neck and bridge provides another means of changing the available tones, such that for K number of matched single-coil pickups (or similar sensors) there are $2^{K-1}$ possible orders of poles between the neck and bridge. This PPA presents a kind of electromagnetic pickup that facilitates changing the physical order of poles and informing any micro-controller switching system of such changes, offering a much wider range of customizable tones.

PPA 62/569,563, 2017 Oct. 8, Method for Wiring Odd Numbers of Matched Single-Coil Guitar Pickups into Humbucking Triples, Quintets and up The Non-Provisional patent application Ser. No. 15/616,396, Baker, 7 Jun. 2017, describes and claims a method for wiring three single-coil electromagnetic pickups, matched to have equal coil electrical parameters and outputs from external hum, into a humbucking triple. This expands that concept to show how many triples, quintets and up any K=Kn+Ks number of matched pickups can produce, with Kn number of pickups with North poles up, or left (right) if lipstick type, and Ks number of pickups with South poles up, or right (left) if lipstick type. Depending upon the sizes of Kn and Ks, a number of combinatorial possibilities exist for both in-phase and out-of-phase or contra-phase signals. The principles and methods with also apply to Hall-effect sensors which use magnets or coils to generate magnetic fields. This PPA meshes with PPA 62/522,487, Baker, 20 Jun. 2017, Single-Coil Pickup with Reversible Magnet & Pole Sensor. It adds humbucking circuits with odd numbers of sensors to the number of humbucking circuits with even numbers of sensors claimed in Non-Provisional patent application Ser. No. 15/616,396

The Birth of Humbucking Basis Vectors

In October of 2017, Baker continued reworking the circuits and concepts for humbucking triples and quints, working with circuit equations for humbucking pairs added in series and parallel to humbucking triples. On October $10^{th}$ he asked himself, "Is there a 5×5 matrix of vectors from which all humbucking circuits can be predicted w/ linear matrix operations?" Including cases where humbucking pairs were added in series and parallel to get humbucking quads, it soon became apparent that for four pickups, the equations to specify the portions of the signals from each pickup at the output could be expressed with no more than three vectors and scalars. Or for K number of pickups, K−1 vectors and scalars. Thus was born the concept of Humbucking Basis Vectors, from which circuits could be constructed that would produce a continuous range of humbucking tones from matched single-coil pickups using only variable gains, with little, if any, mechanical switching.

Because variable gains depend upon active amplifiers, the tonal difference between series and parallel circuits goes away. Individual pickups, eventually including paired pickups, are connected to preamps with high input impedances, and the only tonal difference between series and parallel connections of two pickups depends upon the load impedance presented to them. The lower the relative load impedance, or the higher the relative pickup circuit impedance, the lower the resonant or roll-off frequency caused by adding a tone capacitor to the load. Putting tone capacitors on series or parallel connections of low-impedance preamp outputs has no practical effect on tone. So all those distinctions, and numbers of pickup circuits, are lost in favor of having a continuous range of tones in between the remaining in-phase and contra-phase combinations of pickups with preamps.

PPA 62/574,705, 2017 Oct. 19, Using Humbucking Basis Vectors for Generating Humbucking Tones from Two or More Matched Guitar Pickups Humbucking circuits for any number of matched single-coil guitar pickups, and some other sensors, can be generated from humbucking basis vectors developed from humbucking pairs of pickups. The linear combinations of these basis vectors have been shown to produce the description of more complicated humbucking pickup circuits. This offers the conjecture that any more complicated humbucking circuit can be simulated by the linear combination of pickups signals according to these basis vectors. Fourier transforms and their inverses are linear. This means that the complex Fourier spectra of single sensors can be multiplied by scalars and added linearly according to the same basis vectors to obtain the spectra for any humbucking pickup circuit, or any linear combination in between. These spectra can then be used to order the results according to tone, using their moments of spectral density functions. Which can be used in turn to set the order of linear combinations of pickup signals proceeding from bright to warm or back, without using complicated switching systems. Thus a gradation in unique tones can be achieved by simple linear signal multiplication and addition of single pickup signals, preserving the analog nature of the signals. The granularity of the gradation of tones depends only upon the granularity of the scalars used to multiply the basis vectors to obtain the changes in gain for each pickup signal. The use of humbucking basis vectors can also be simulated by analog circuits, which are scalable to any number of pickups.

PPA 62/599,452, 2017 Dec. 15, Means and Methods of Controlling Musical Instrument Vibration Pickup Tone and Volume in SUV-Space The PPA 62/599,452 recognized that in SUV-space the multiplying scalars are a vector, and that the length of the vector changes only the amplitude not the tone. So equal-length vectors can be expressed as $s^2+t^2+u^2+\ldots=1$. This equation also means the for K number of pickups with K−1 number of controlling SUV scalars, only K−2 of those scalars need to be changed to change the tone, or angle in SUV-space. Using the trig identities such as $[\sin^2\theta+\cos^2\theta=1]$ and $[(\sin^2\theta+\cos^2\theta)\sin^2\phi+\cos^2\phi=1]$, sine and cosine pots can be used to express the variable gains in the circuits of PPA 62/574,705, and ganged to produce K−2 controls. So for a 3-coil guitar, only K−2=3−2=1 control is needed, and this system in scalable to any number of matched pickups. But there's a catch; contra-phase tones tend to have much less amplitude than in-phase tones. Even if the SUV-vector stays constant, that doesn't mean the output level does. This gets addressed in a later submission.

Non-Provisional patent application Ser. No. 15/917,389, 2018 Jul. 14, Single-Coil Pickup with Reversible Magnet & Pole Sensor This invention offers several variations of embodiments, with both vertical and horizontal magnetic fields and coils, of single-coil electromagnetic vibration pickups, with magnetic cores that can be reversed in field direction, so that humbucking pair circuits can produce, from K number of single-coil pickups, $2^{K-1}$ unique pole position configurations, each configuration producing a different set of K*(K−1) circuit combinations of pairs, phases and series-parallel configurations out of the possible 2*K*(K−1) of such combinations. This invention also offers a method using simulated annealing and electromagnetic field simulation to systematically design, manufacture and test possible pickup designs, especially of the physical and magnetic properties of the magnetic cores.

PPA 62/711,519, 2018 Jul. 28, Means and Methods of Switching Matched Single-Coil and Dual-Coil Humbucking Pickup Circuits by Order of Tone A very simple guitar pickup switching system with just 2 rules can produce humbucking circuits from every switching combination of pickup coils matched for response to external hum: 1) all the negative terminals (in terms of phase) of the pickups with one polarity of magnetic pole up (towards the strings) are connected to all the positive terminals of the pickups with the opposite pole up; and 2) at least one terminal of one pickup must be connected to the high terminal of the switching system output, and at least one terminal of another pickups must be connected to the low output terminal. The common pickup connection is grounded if the switching output is to be connected as a differential output, and ungrounded if the either terminal of the switching output is grounded as a single-ended output. So for 2, 4, 5, 6, 7, 8, 9 and 10 matched pickup coils, this switching system can respectively produce 1, 6, 25, 90, 301, 966, 3025, 9330 and 28,541 unique humbucking circuits, rising as the function of an exponential of the number of pickup coils. All of the circuits will have the same signal output as 2 coils in series, modified considerably by phase cancellations. This works for either matched single-coil pickups, or matched dual-coil humbuckers, or any combination of both, so long as all the pickup coils involved have the same response to external hum. FFT analysis of the signals of all strings strummed at once allows the tones to be ordered in the switching system from bright to warm or vice versa. The switching system can be electromechanical switches, but this limits utilization of all the possible tones, and an efficient digitally-controlled analog switching system is presented.

Non-Provisional patent application Ser. No. 16/139,027, 2018 Sep. 22, Means and Methods for Switching Odd and Even Numbers of Matched Pickups to Produce all Humbucking Tones, Granted as U.S. Pat. No. 10,380,986, 2019 Aug. 13

This invention discloses a switching system for any odd or even number of two or more matched vibrations sensors, such that all possible circuits of such sensors that can be produced by the system are humbucking, rejecting external interferences signals. The sensors must be matched, especially with respect to response to external hum and internal impedance, and be capable of being made or arranged so that the responses of individual sensors to vibration can be inverted, compared to another matched sensor, placed in the same physical position, while the interference signal is not. Such that for 2, 3, 4, 5, 6, 7 and 8 sensors, there exist 1, 6, 25, 90, 301, 966 and 3025 unique humbucking circuits, respectively, with signal outputs that can be either single-ended or differential. Embodiments of switching systems include electro-mechanical switches, programmable switches, solid-state digital-analog switches, and micro-controller driven solid state switches using time-series to spectral-series transforms to pick the order of tones from bright to warm and back.

Non-Provisional patent application Ser. No. 16/156,509, 2018 Oct. 10, Means and Methods for Obtaining Humbucking Tones with Variable Gains This invention discloses a basic humbucking pair circuit of 2 matched coils or other sensors, which is connected in a particular way to other humbucking pair circuits, to be combined with variable gains in a way that physically simulates the construction of a linear vector of humbucking pair tones. With this physical embodiment, every possible switched humbucking circuit of J>1 number of matched vibration sensors can be constructed, connected by all the continuous variation of humbucking tones in between. It effectively does away with most electro-mechanical switching of guitar pickups, and the inherent limitations of that approach, including duplicate circuits, in return for a continuous range of tones.

PPA 62/835,797, 2019 Apr. 18, More Embodiments for Common-Point Pickup Circuits in Musical Instruments This invention uses the common-point connection principles of Non-Provisional patent application Ser. No. 16/139,027 (prior to the granting of U.S. Pat. No. 10,380,986) applied to a circuit with 3 matched single-coil pickups and another embodiment with 3 matched dual-coil humbucking pickups. In the 3-coil circuit, the common point is intentionally grounded to obtain all the pickup tone signals previously available from a standard 5-way Stratocaster (™Fender) electric guitar, plus all the humbucking pair and triple tone signals when the common point is not grounded, for a total of 12 switched circuits, with 9 to 10 distinct tones. In the 3-humbucker, 6-coil circuit, additional mode switches are added to use the magnetic North and South coils individually, so as to simulate pickups with reversible magnets. This circuit offer at least 18 different tone circuits, which the later NPPA found increased.

Non-Provisional patent application Ser. No. 16/752,670, 2020 Feb. 1, Modifications to a Lipstick-Style Pickup Housing and Core to Allow Signal Phase Reversals in Humbucking Circuits, Currently in Prosecution This invention follows Non-Provisional patent application Ser. No. 15/917,389, showing how the entire pickup core, coil form, coil, magnet and coil contacts, can be made to be removed from its housing, flipped so as to reverse the magnetic field and the vibration signal, and reinserted without changing the humbucking effect of the circuit.

Non-Provisional patent application Ser. No. 16/812,870, 2020 Mar. 9, Modular Single-Coil Pickup, Currently Waiting for Examination This invention follows Non-Provisional patent application Ser. No. 16/752,670, the construction of which required that the guitar body be lowered to permit access to the pickup core. This invention redesigns the removable and reversible pickup core so that mounting under a pickguard is restored.

Non-Provisional patent application Ser. No. 16/840,644, 2020 Apr. 6, More Embodiments for Common-Point Pickup Circuits in Musical Instruments, Currently Allowed & Waiting for Payment of the Issue Fee This NPPA follows PPA 61/835,797, this time finding that the 3-humbucker circuit presents 66 different circuits out of 108 different switch combinations. As previous experiments have shown, it shows in FIG. 14 that most of the 66 tones bunch together at the warm end. During the prosecution of this NPPA, a 3-coil Fender Stratocaster was modified to produce all the tones, nominally humbucking or not, of a standard 5-way switch, plus 1, and to produce all the possible humbucking pair and triple tones, for a total of 12 switched circuits. Of those tones, perhaps 9 to 10 are distinct. The local guitarist who is currently beta-testing this prototype, at the time of the filing of this application, has stated that the humbucking tones, with variations in out-of-phase tones, sounds like a Mustang electric guitar.

Technical Problems Resolved

Most mass-market guitars with two dual-coil humbuckers use a 3-way switch, and most 3-coil guitars use a 5-way switch. Even when pickup switching systems are invented which offer hundreds to thousands of unique pickup circuits, mechanical switches have had to be replaced with digital-analog cross-point switches, driven by micro-controllers. Which is not a bad thing, but requires additional resources in battery power and software programming.

The most pervasive and persistent technical problem comes from the limitations of electro-mechanical switches. Those which are cheap and small enough to be used under the pick guards of electric guitars in regular mass production only have from 3 to 66 choices of pickup circuits, and those limited to certain types of circuits. In those circuits, only a few, if any, of the circuits which can be achieved can be ordered in any semblance of bright to warm tones. The rest are effectively random, and most of the tones tend to bunch at the warm end. The more tones available, the closer they tend to bunch together, even if the range of tones is extended. So some confusion in using them can be expected.

To this inventor's knowledge, to date the only pickup signal selection systems which generate a continuous range of tones are limited to simple potentiometer-controlled signal splitters, or faders, which mix the signals of two or more pickups. One such system appears in FIG. 36 of U.S. Pat. No. 9,401,134B2 (Baker, 2016). Until Non-Provisional patent application Ser. No. 16/156,509 and this NPPA, no continuous tone system, expandable to any number of pickups of any kind, has been presented which can span the tones of the tens to thousands of pickup circuits possible from the full range of series-parallel and all-humbucking circuits, which have been presented in Non-Provisional patent application Ser. Nos. 15/616,396, 16/139,027 and 16/840,644.

In this system, only the pickups in the humbucking pair of the basic circuit need to be matched to each other to cancel hum. This system allows different types of sensors to be included in it, so long as they come in matched pairs and those matched pairs are used together in individual basic circuits. Thus electro-magnetic sensors and piezo-electric sensors and even strain-gage sensors can be mixed in the system. It also allows, as did the previous humbucking systems disclosed by this Inventor, for expanding the range of tones by reversing the magnets of electro-magnetic coil-based sensors.

SUMMARY OF INVENTION

Excepting the previous prior art of this Inventor, this invention discloses the hitherto unknown, non-obvious, beneficial and eminently usable means and methods to produce a wide range of switched humbucking pickup circuits with variable-gain analog amplifiers and summers, as well as providing all the continuous tones in between. The pickups used here are matched to have the same internal impedance and to produce the same response to external hum. While primarily intended for matched single-coil electromagnetic guitar pickups and dual-coil humbucking pickups, the principles can apply to any other sensor or type of sensor which meets the same functional requirements. They may, for example, apply to capacitive vibration sensors in pianos and drums, or piezoelectric sensors in wind instruments. Furthermore, sensors of different types and sensitivities may be mixed in the total circuit, so long as the two in each basic circuit are matched to each other with respect to hum. But they will lose versatility because they cannot be interconnected at the sensor level.

From the electronic circuit equations of pickup circuits, these circuits and methods express the output voltages of humbucking pickup circuits as a sum of the humbucking basis vectors, each multiplied by a scalar representing a variable gain. The scalars can be positive or negative within their ranges to simulate the phase reversals, and partial phase reversals, of individual humbucking pairs, as well as the linear mixing of signals. The scalars can also combine humbucking pairs into humbucking triples, quads, quintets, hextets, and up. This approach will also accommodate pickups with reversible magnetic poles, with different pole-position configurations, while maintaining humbucking outputs.

In a circuit with J number of pickups, all of the same type, there are J−1 humbucking pairs. If all of the humbucking pairs are comprised of different types and sensitivities of pickups outside of each pair, there are J/2 humbucking pairs that can produce signals for the output. If there a J1 number of matched pickups of one type, and J2 number of matched pickups of a different type, then there are J1−1 plus J2−1 different humbucking pair signals that can be mixed together in the circuit output. It is also possible to create even more humbucking tones with electro-magnetic coil vibration sensors simply by reversing the orientation of each magnet.

Fast Fourier Transforms (FFTs), allow a micro-controller or micro-computer to transform digitized samples of selected outputs into frequency spectra and to predict the responses over the whole continuous range of basis vector scalars. This can be used to create maps of relative output signal amplitude, mean frequencies and moments of the spectra, by which to adjust and equalize system signal output, and to order system scalar selections by measures of tone. Inverse FFTs, can then be used to convert predicted outputs back into audio signals, fed though a digital-to-analog (D/A) converter to the system audio output, to allow the user to choose favorites or a desired sequence of tones. Using such information the programmable digital controller can adjust the basis vector scalars, simulated by means of digital potentiometers, to control amplitude and tone.

This system can provide the user with a simple interface to shift continuously through the tones, from bright to warm and back, without ever having to know which pickups and basis vector scalars are used to produce the amplitudes and tones. This invention does not provide the software programming for such functions, but does disclose the digital-analog system architecture necessary to achieve those functions. A great deal of study remains to explore the mapping and control of relative amplitudes and tones, especially when using matched pickups with reversible magnetic poles, which produce different combinations of in-phase and contra-phase signals.

Figure 2:
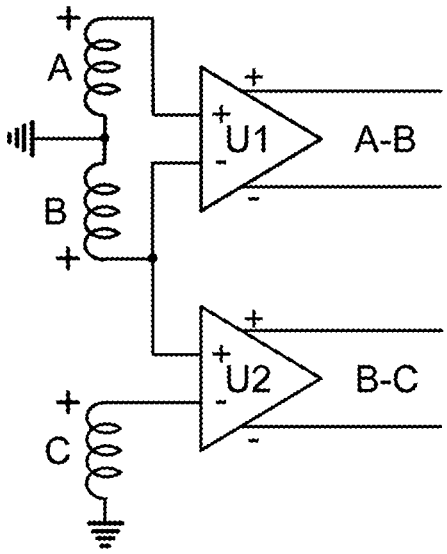

FIG. 2 shows how three matched pickups (A, B & C), with the polarities of the hum signals indicated by "+", properly connect to two differential amplifiers (U1, U2) to produce humbucking outputs (A−B, B−C).

Figure 3:
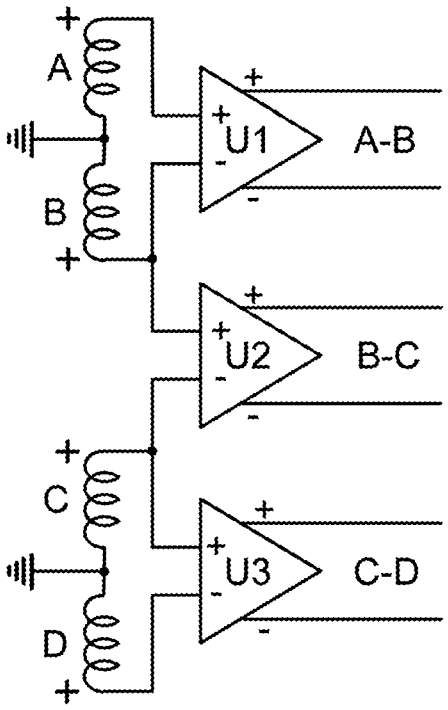

FIG. 3 shows how two dual-coil humbuckers, or four matched single-coil pickups (A, B, C & D), with hum polarities indicated by "+", properly connect to three differential amplifiers (U1, U2, U3) to produce humbucking signals (A−B), (B−C) and (C−D).

Figure 4A:
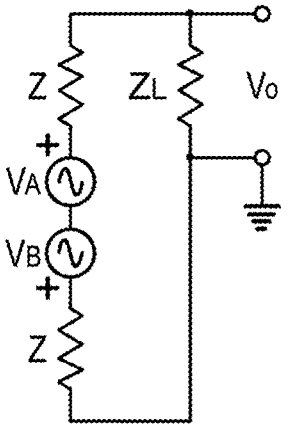
Figure 4B:
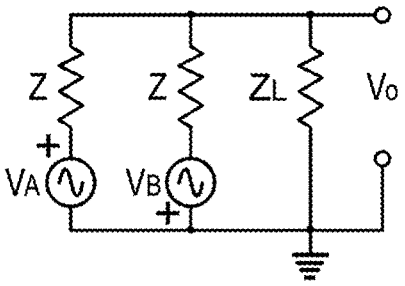

FIGS. 4A-B show, using circuits for matched single-coil pickups, with equal impedances, Z, and hum voltages $V_A$ and $V_B$, properly connect in series (4A) and parallel (4B) to produce humbucking signals across load impedance, $Z_L$, at a single-ended output, Vo.

Figure 5A:
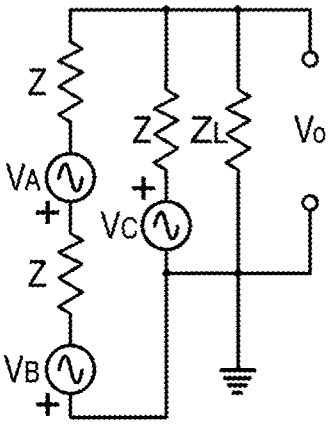
Figure 5B:
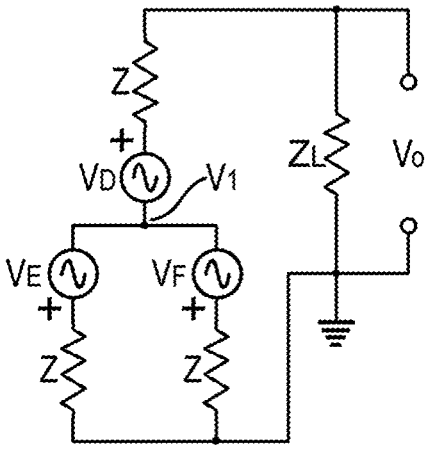

FIGS. 5A-B show connections for matched single-coil pickups as humbucking triples in parallel (5A) and series (5B), coil impedances, Z, hum voltages (VA, VB, VC, VD, VE, VF), and a load impedance, $Z_L$, across the output, Vo. The voltage node, V1, is used in circuit equations.

Figure 6:
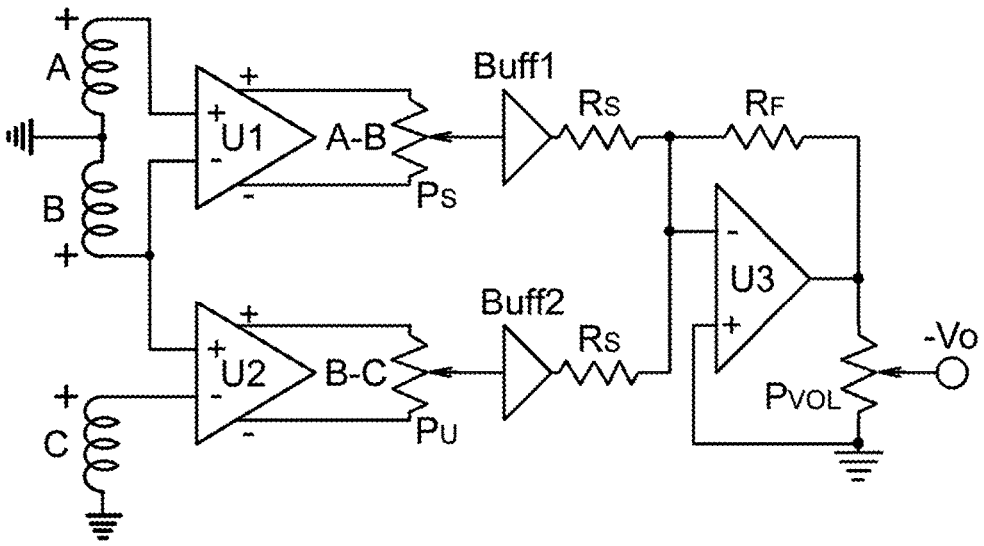

FIG. 6 shows how two Cosine-Sine control pots ($P_S$, $P_U$) control signal proportions of the humbucking signals from the 3-coil setup in FIG. 2, which are then buffered by unity gain amplifiers (Buff1, Buff2), summed through summing resistors (Rs) into an output amplifier (U3) with gain $R_F$/Rs, to a volume pot ($P_{VOL}$) and output, Vo.

Figure 7:
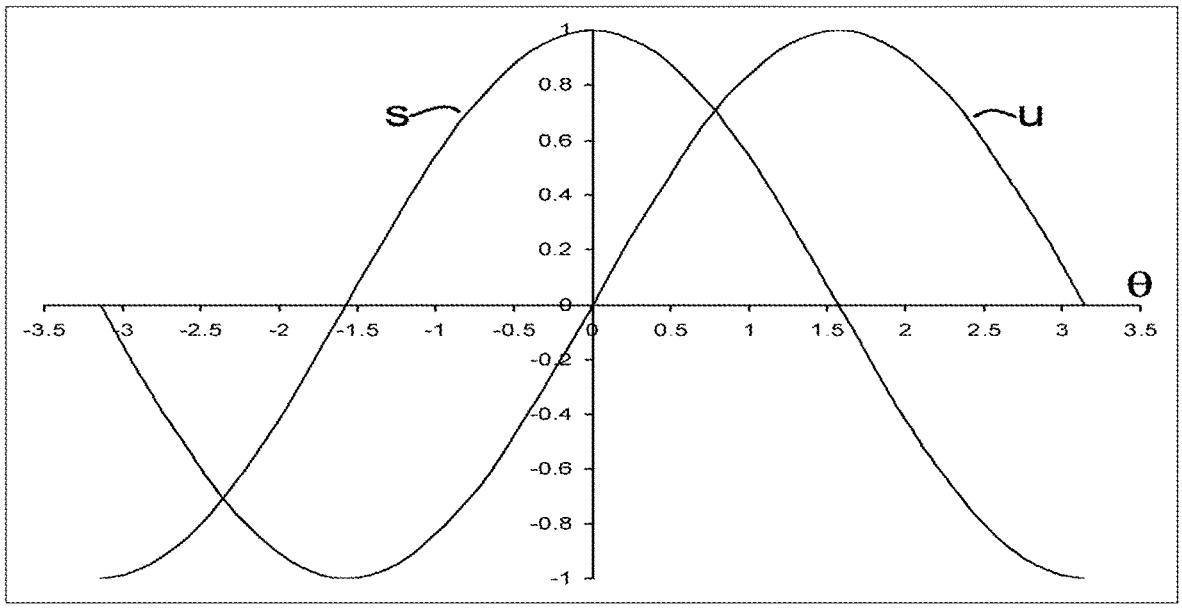

FIG. 7 shows the voltage transfer curves for ideal 360-degree sine (u) and cosine (s) pots (Pu and Ps, respectively in FIG. 6), where U1 and U2 in FIG. 6 have gains of 2, such that the vector defined by (s,u) traces out the unit circle in FIG. 7. This way avoids the null output that is possible with center positions when Pu and Ps are linear pots.

Figure 8:
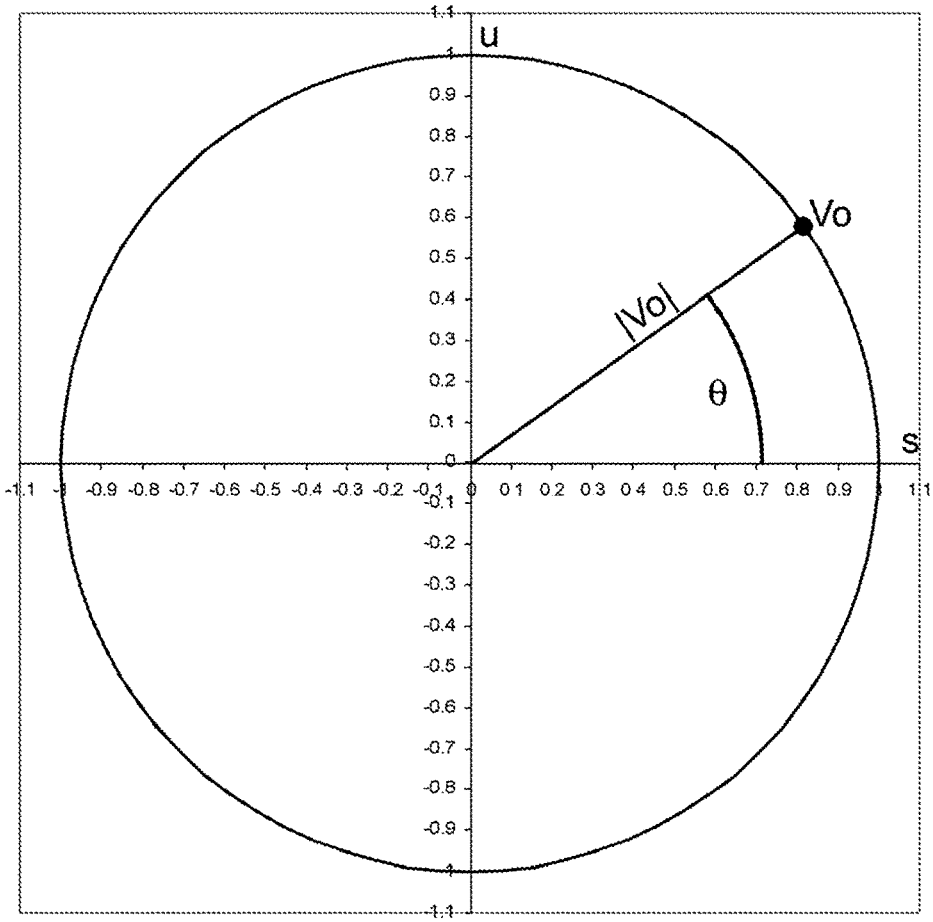

FIG. 8 shows the unit circle of humbucking tones created by the humbucking basis vector coefficients, S and U, when the 3-coil signals in FIGS. 2 & 6 add without any phase cancellation (not very likely). It is based on the trig identity that sine squared plus cosine squared equals one.

FIGS. 9A-D show how physical half-wave sine (Pu) and cosine (Ps) pots can be used to simulate the humbucking basis vector coefficients, S and U. In this plot, $\theta=\pi*\text{rot}-\pi/2$. The curves get shifted Pi/2 to the right on the axis, because the "center point" on the pot taper profile at 50% rotation, represents the mathematical zero on the axis. The signal voltage (V) is applied to the center tap of the cosine pot (Ps in 9A), which is grounded at the ends and has the rotational taper Ps in 9D, which produces the voltage versus rotation curve S in 9C. The differential voltages +V and −V are applied to the ends of the sine pot (9B), which has the rotational taper Pu in 9D, and produces the voltage output U in 9C.

Figure 9A:
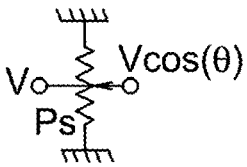
Figure 9B:
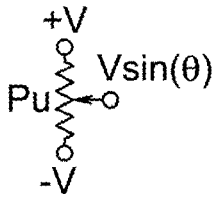
Figure 10:
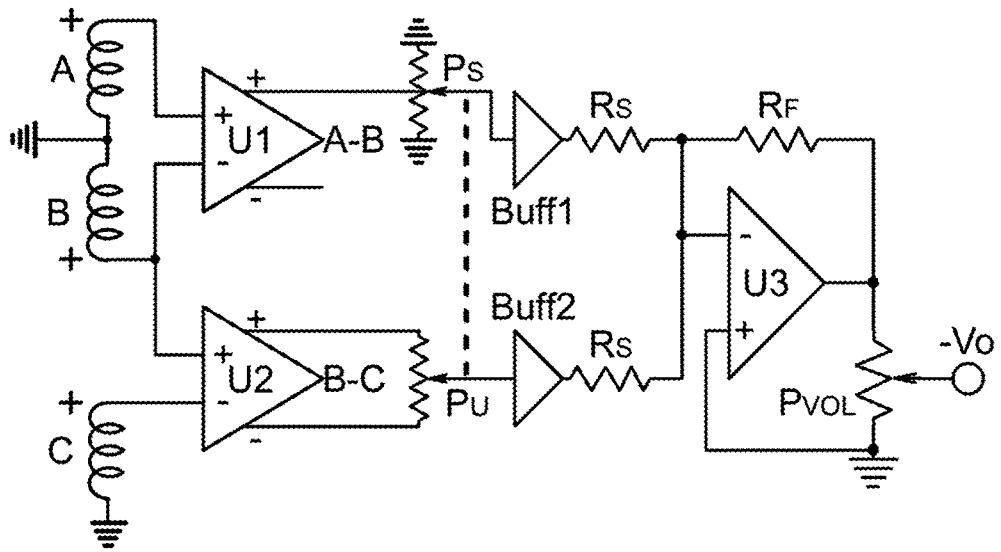

FIG. 10 shows how the sine (Pu) and cosine (Ps) pots are used in the circuit from FIG. 6, according to FIGS. 9A-B. Pu and Ps are two gangs on one pot, so that they rotate synchronously.

Figure 11:
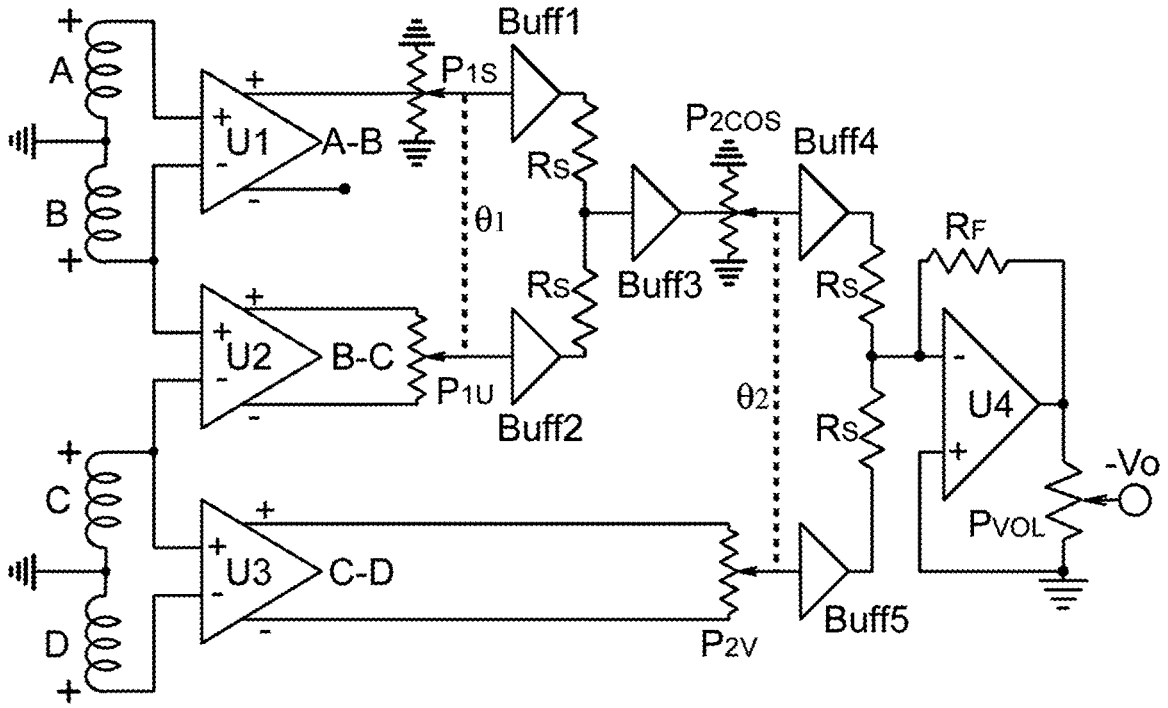

FIG. 11 shows how this kind of circuit can be extended to four matched single-coil pickups (or two matched dual-coil humbuckers), simulating sine squared plus cosine squared trig identities for two rotational angles, θ1 and θ2, using two 2-gang pots, P1 and P2, with cosine gangs (P1*s* & P2 cos) and sine gangs (P1*u* and P2*v*), where s, u and v represent the humbucking basis vector coefficients, S, U and V. It requires three differential amplifiers (U1, U2, U3), five buffer amplifiers (Buff1-5) and a summing output amplifier (U4).

Figure 12:
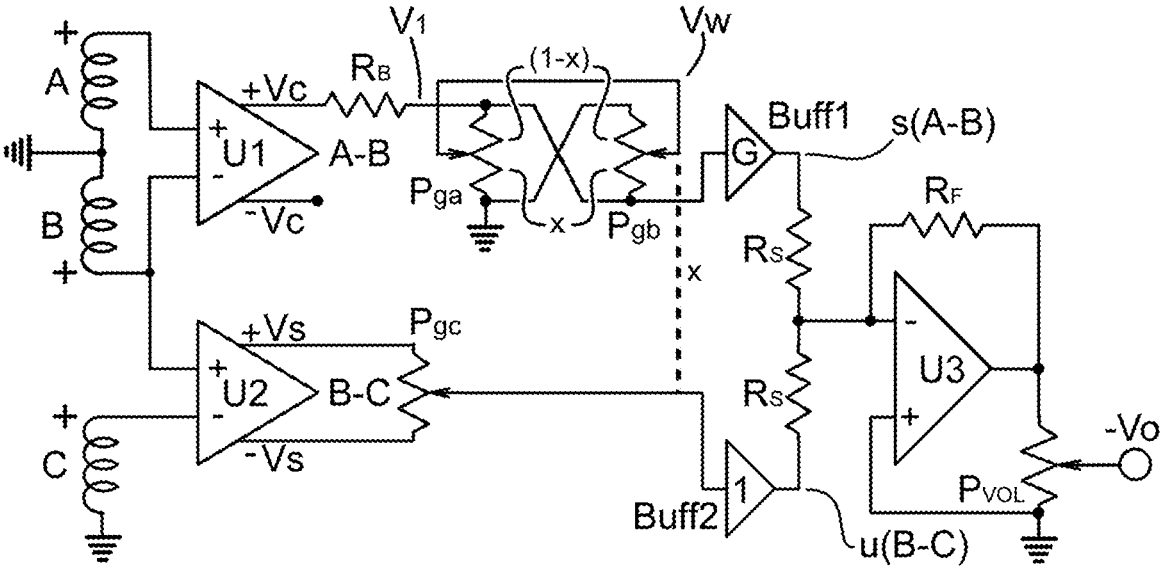
Figure 13:
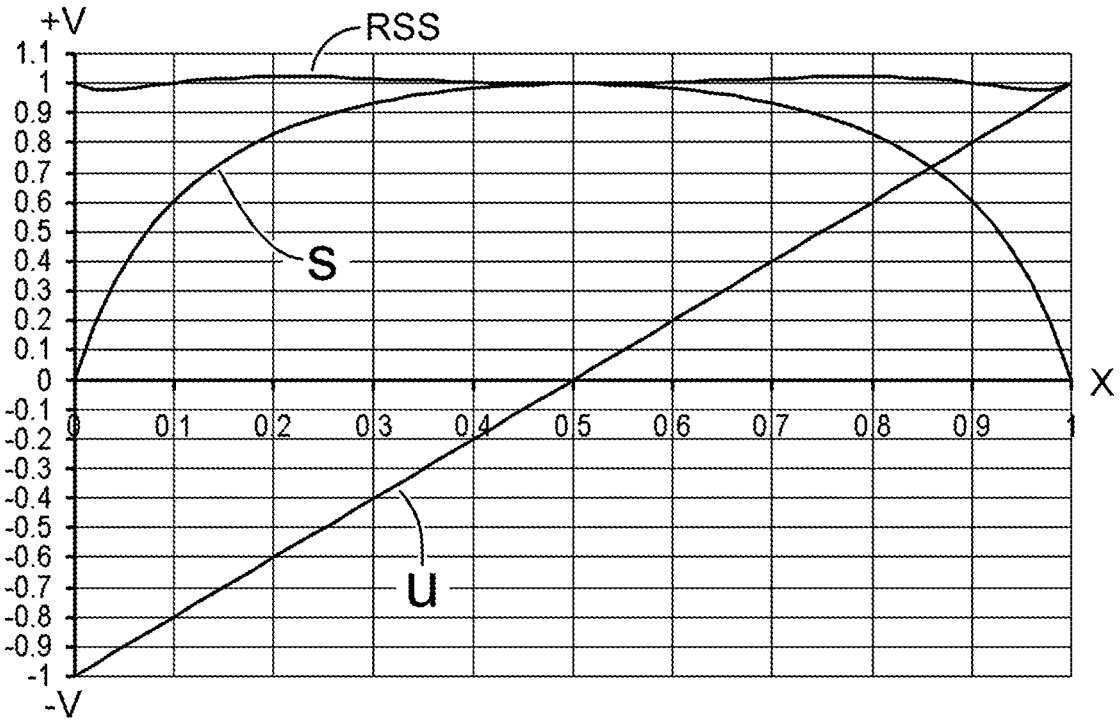

FIGS. 12 & 13 shows how a 3-gang linear pot (Pg with gangs a-c) can approximate a unit curve as in FIG. 7, and replace much more expensive sine- and center-taped-cosine-ganged pots in FIG. 10. The resistor $R_B$ and the a and b gangs of Pg produce an output (Vw) from the differential voltage, Vc, which follows the S curve in FIG. 13, as does $V_1$, the voltage at the connection of $R_B$ and Pg. Gang c of Pg is a simple linear taper that produces the curve U in FIG. 13. The curve RSS in FIG. 13 is the root sum of the squares of S and U, approximating 1, plus or minus a few percent. This shows a very rough approximation of orthogonal sine-cosine functions with much cheaper components, which still produces a usable output.

Figure 14:
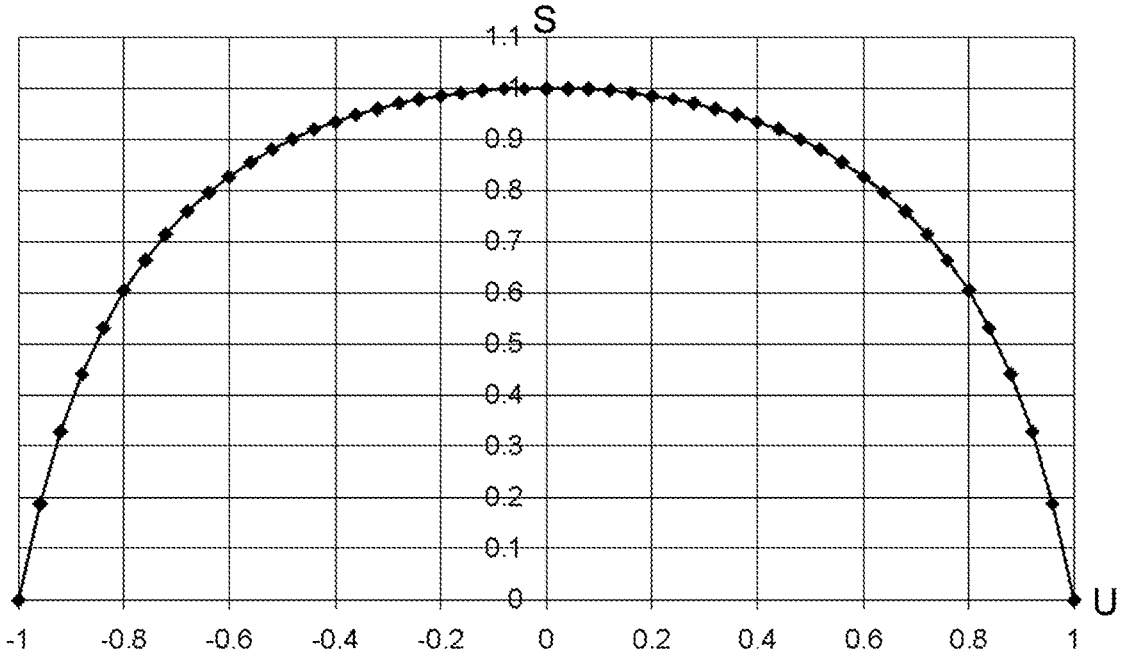

FIG. 14 shows the distribution of points in the space (U,S) along the RSS curve in FIG. 13, for equal rotational increments, showing a higher resolution about (U,S)=(0, 1).

Figure 15:
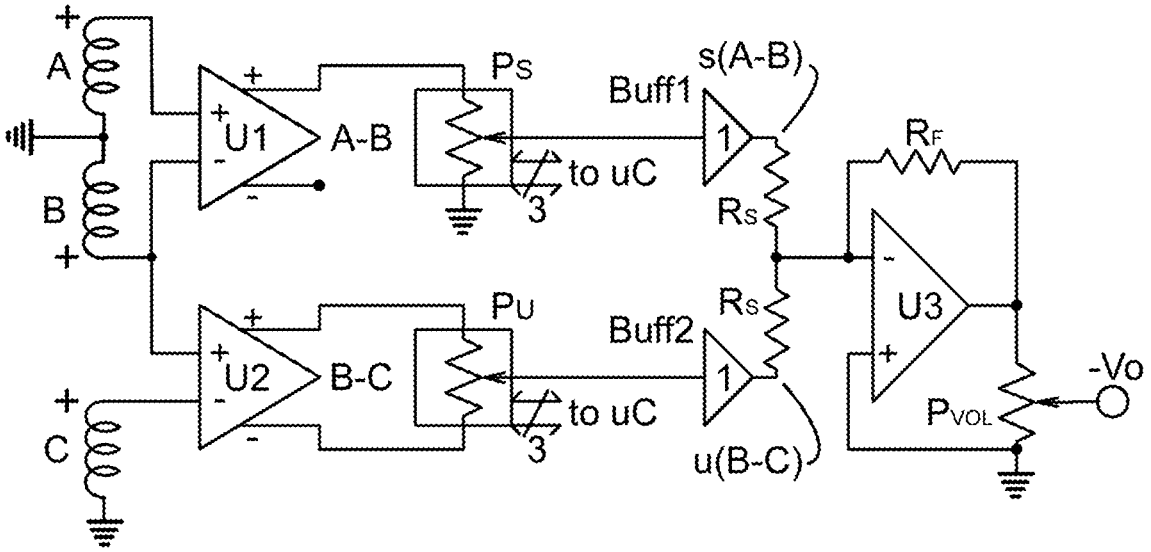

FIG. 15 shows the sine and cosine pots in FIG. 10 replaced with linear digital pots, where the wipers are set to sine or cosine functions by software in a micro-controller (uC, not shown).

Figure 16:
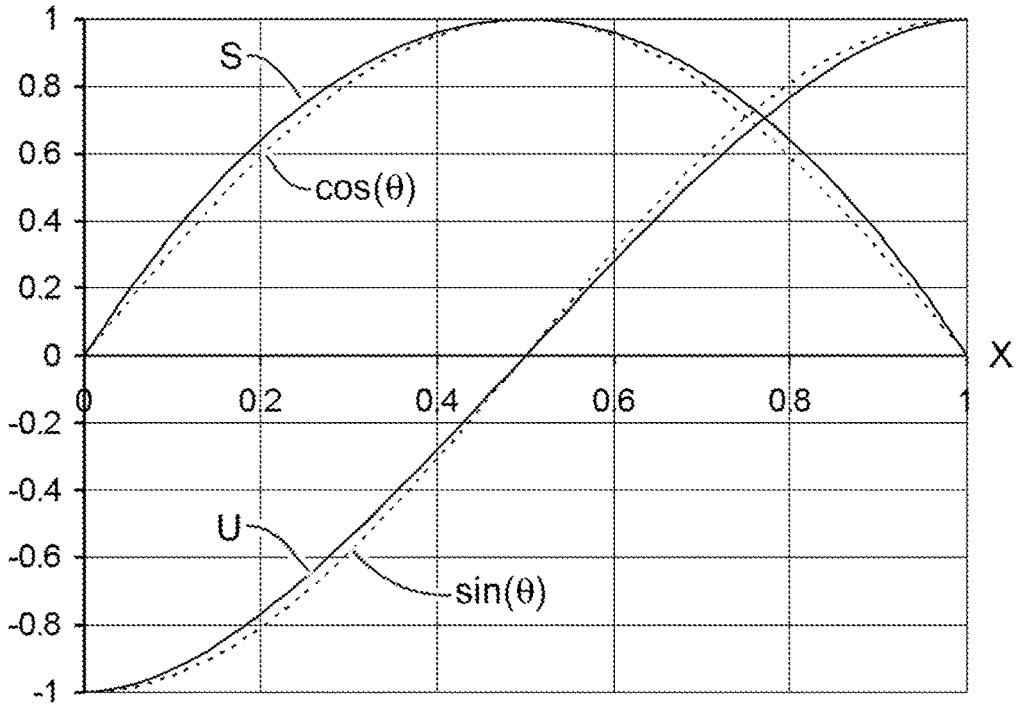

FIG. 16 shows the plots for the digital pot cosine and sine approximations, S and U (solid lines), from Math 14, compared to ideal values (dotted lines).

Figure 17:
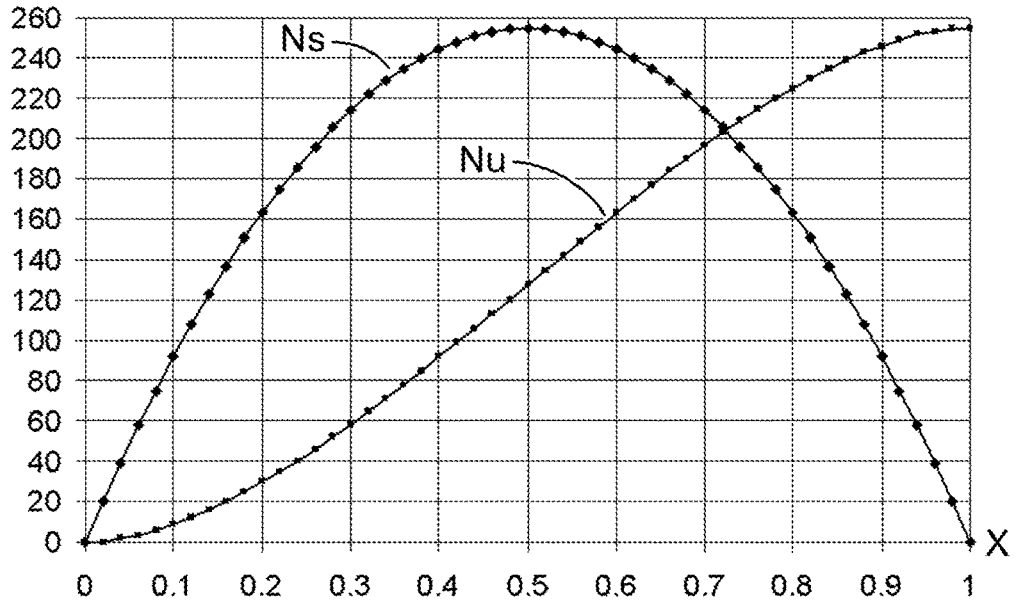

FIG. 17 shows the distribution of points numerically generated by Math 14 for S (Ns) and U (Nu).

Figure 18:
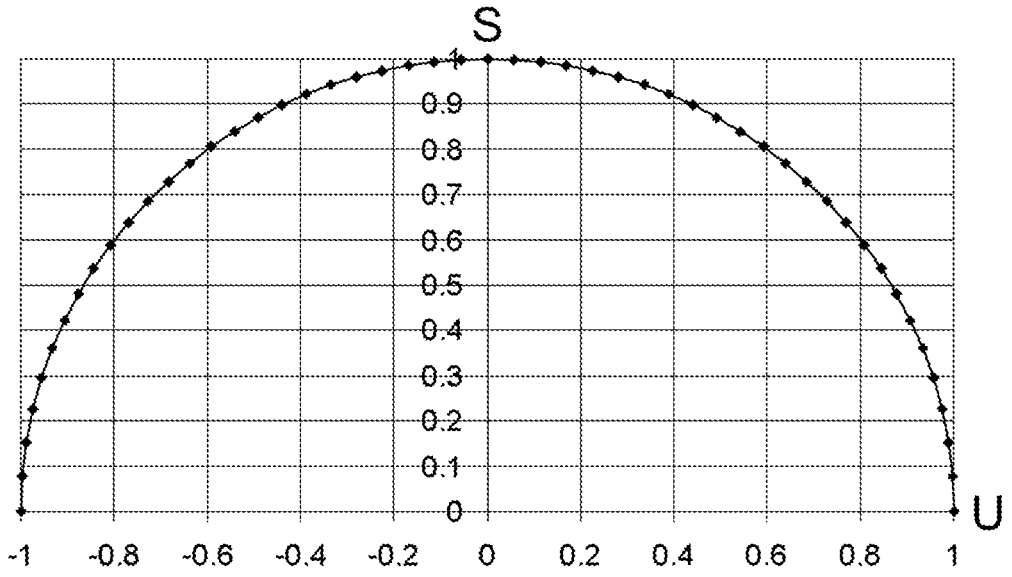

FIG. 18 shows the points from FIG. 17 plotted on the (U,S) plane, with an improvement in resolution along the half-circle, compared to FIG. 14.

Figure 19:
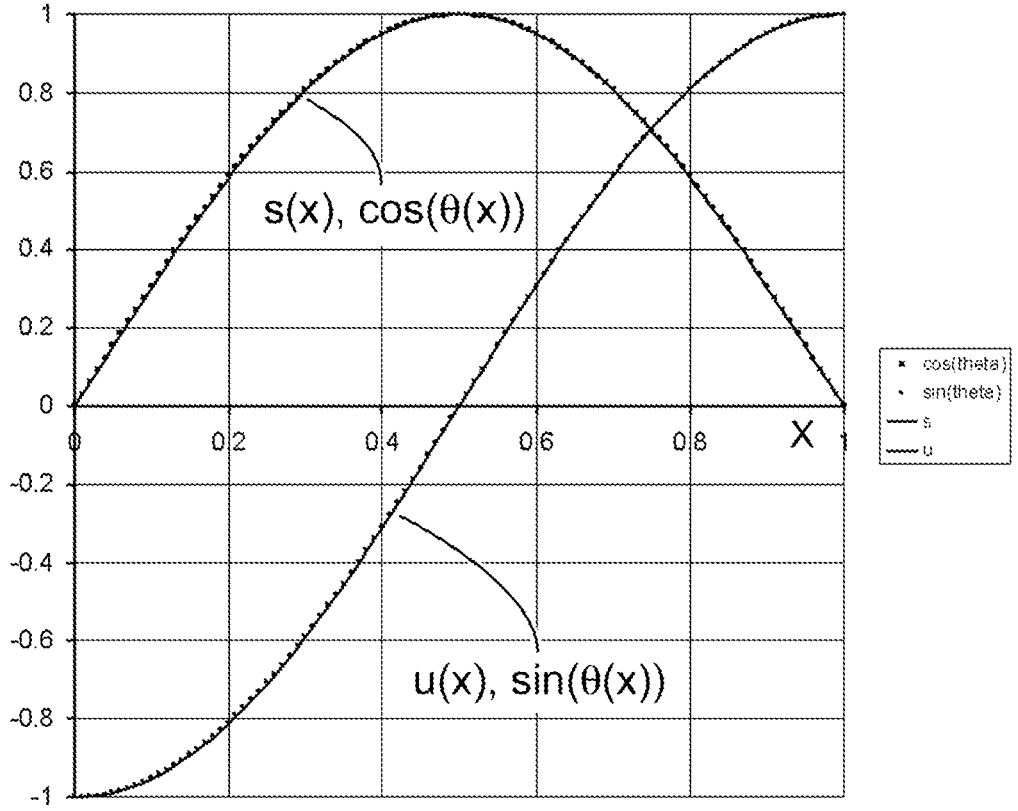

FIG. 19 shows plots of s(x), and u(x) (dotted lines), and cosine and sine (solid lines), for the better polynomial approximation in Math 15.

Figure 20:
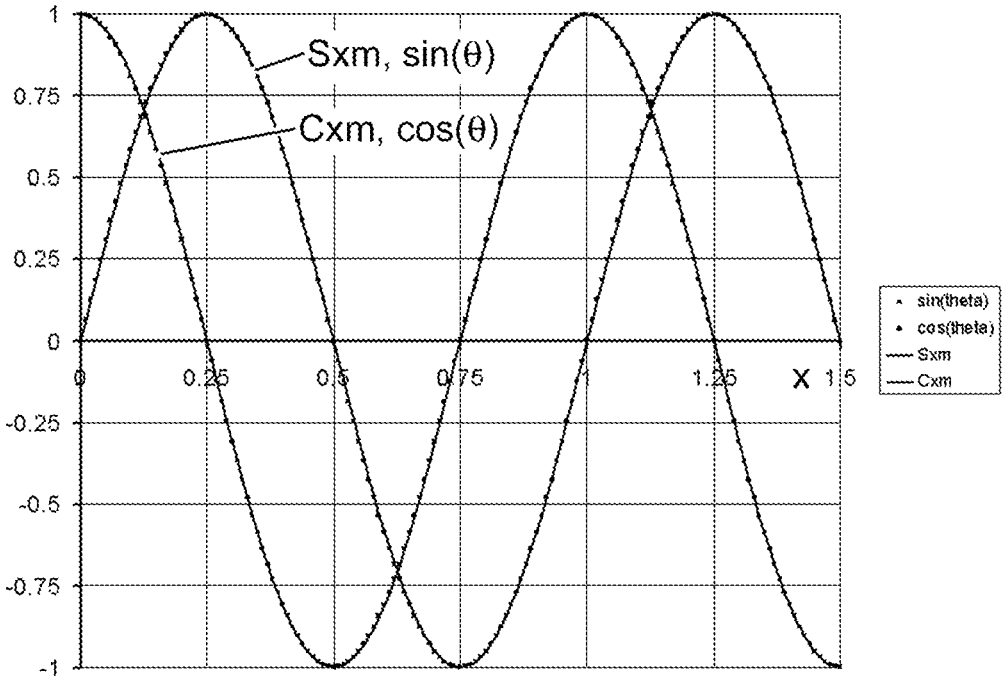

FIG. 20 shows the same kind of plot as FIG. 19, for and even better approximation of cosine and sine in Math 16 & 17, suitable for use in FFTs.

Figure 21:
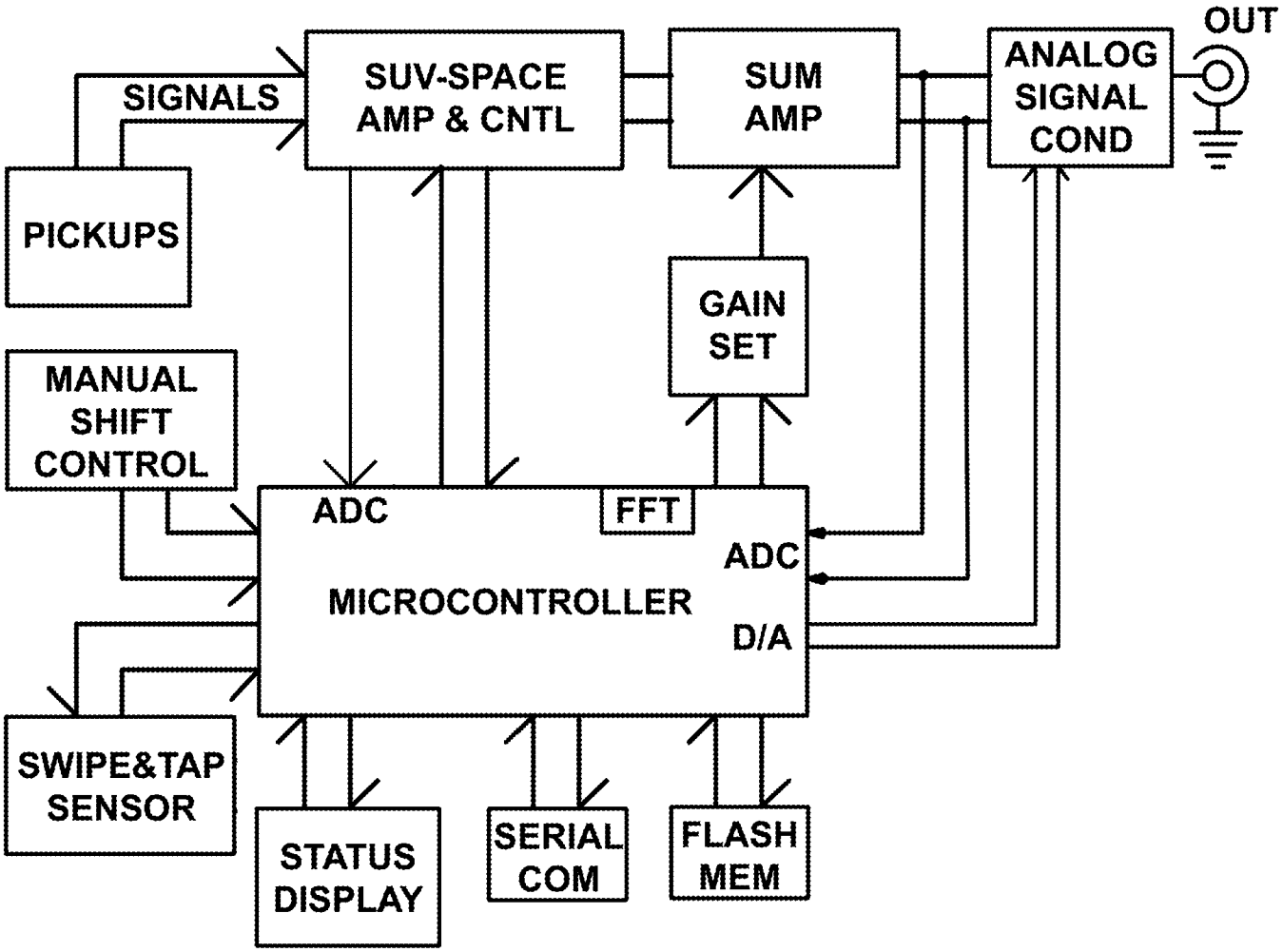

FIG. 21 shows the system architecture for a micro-controller which drives digital pots and gains to set humbucking pair vectors in SUV space, adds the resulting signals together and sends the output to analog signal conditioning. The signal path from pickups to output is analog, with the uC setting only the gains, according to a manual tone shift control or a tap and swipe sensor. It uses analog to digital converter (ADC) inputs to evaluate the tones and amplitudes of the pickup and humbucking vector output signals. Serial communications (Serial Com) allow both control and reprogramming. Optional flash memory (Flash Mem) allows more complex programming and/or expanded on-board storage for FFT processing. The FFT module can be either hardware in or off the uC, or entirely in software, using the ADCs to sample signals. The digital to analogy (D/A) output allows the user to listen to sampled chords or strums from either separate humbucking pairs, or reassembled inverse FFTs, representing any point in SUV-space.

Figure 22:
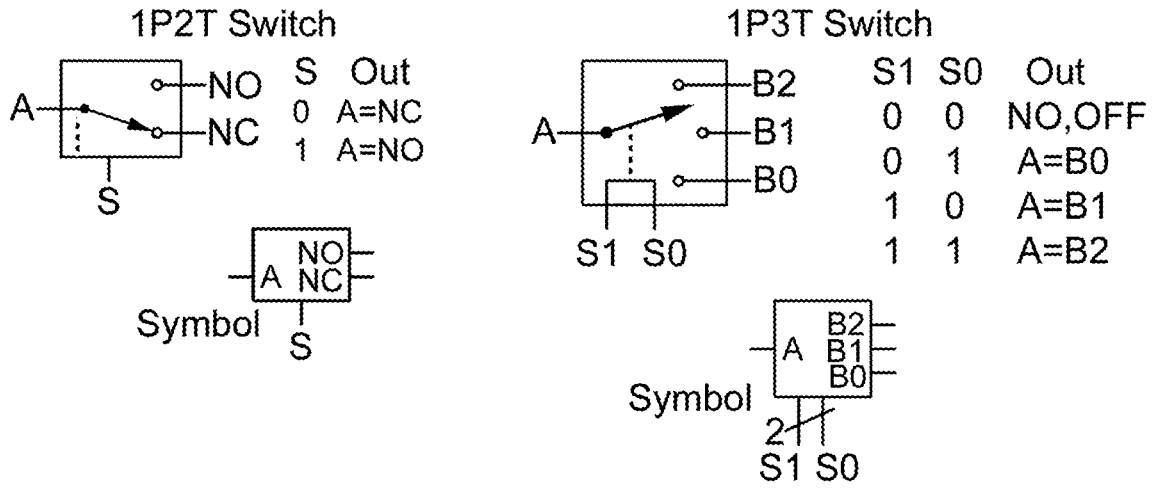
Figure 23:
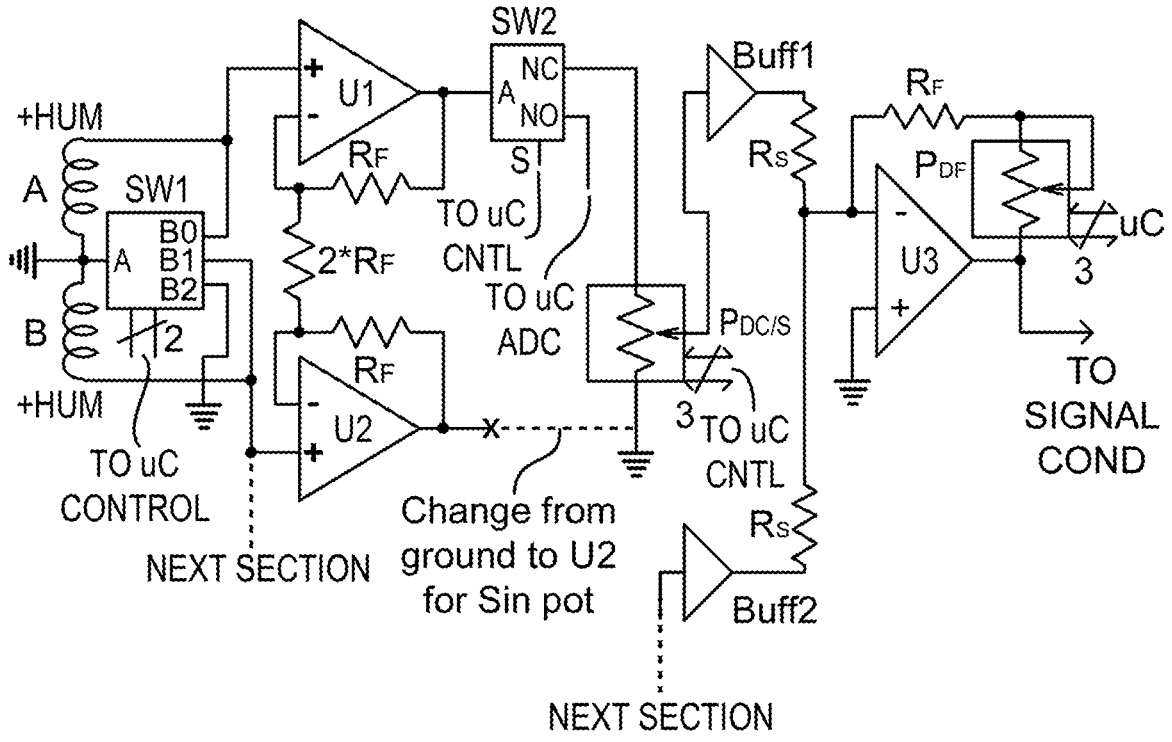

FIG. 22 shows the circuit diagrams and symbols for digitally-controlled analog switches, a 1P2T and a 1P3T switch, commonly available on the electronics market in surface-mount packaging, and used in FIG. 23. The 1P2T switch has a single pole, A, normally open, NO, and normally closed, NC, throws, and a digital control line, S. The 1P3T switch has a single pole, A, two digital control lines, S0 & S1, which connect A to nothing (NO, OFF), or the poles B0, B1 or B2, as shown in the control table.

FIG. 23 shows the embodiment of the basic building block circuit, when controlled by a micro-controller, uC (not shown), or some other digital processor. The nominally negative hum phase of sensors A and B is grounded, leaving the positive hum phases to connect to the differential amplifier formed by U1, U2 and the $R_F$ resistors. SW1, a 1P3T digital/analog switch grounds the signal from A or B or neither, according to 2 digital control lines from the uC, either to facilitate optional testing of the individual sensors, or to allow the humbucking pair signal (A−B) to pass on. The 1P2T digital/analog switch SW2 either allows the humbucking pair signal to go to the sine-cosine-programmed digital pot, $P_{DC/S}$, in the NC state, or to go to the uC analog-to-digital converter (ADC) when A is connected to the NO output by its digital control signal, S. The current circuit is shown with $P_{DC/S}$ set up as a half-cosine pot. But if the ground terminal is replaced by the line from U2, it can be programmed to be a half-sine pot. The dotted lines going to NEXT SECTION allow for the functional equivalents of FIGS. 10 & 11, with extensions for more sensors as necessary. The buffer and summer output, Buff1, Buff2, U3, $R_S$, $R_F$ and $P_{DF}$ must be modified with more variable gain stages if more sensors are used, with more summers as necessary.

Figure 24:
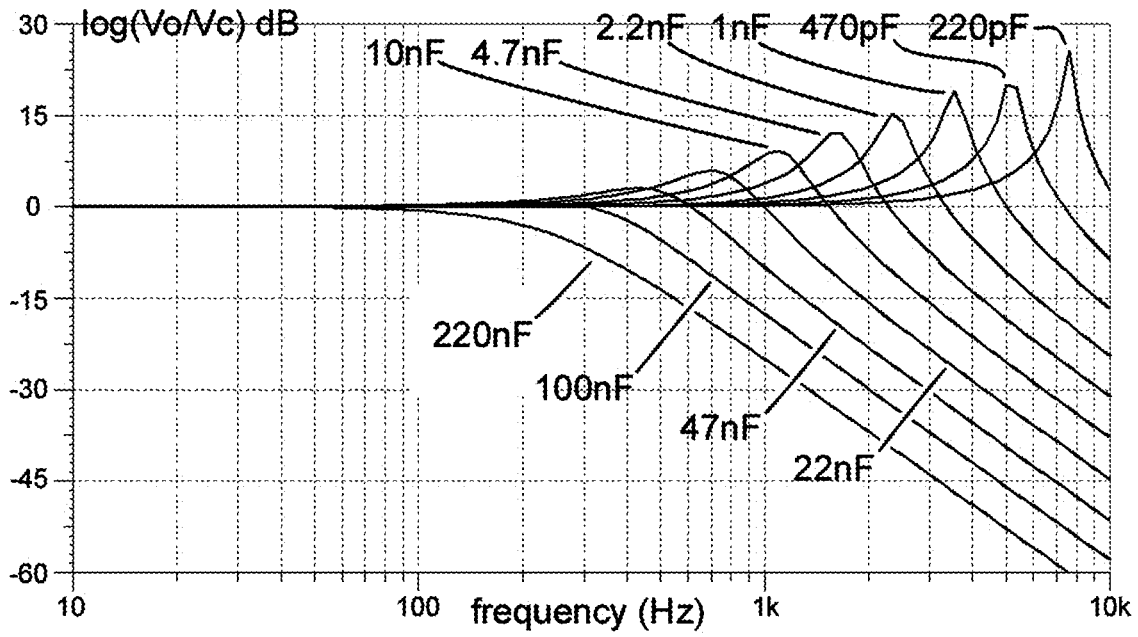

FIG. 24 shows the resonance curves for a pickup with an inductance of 2H, a resistance of 5 k-ohms, and various capacitors in parallel with it, from 220 pF to 220 nF, plotted as log response in decibels (dB) against frequency in Hz, illustrating how various values of tone capacitor change the self-resonance of the pickup.

Figure 25:
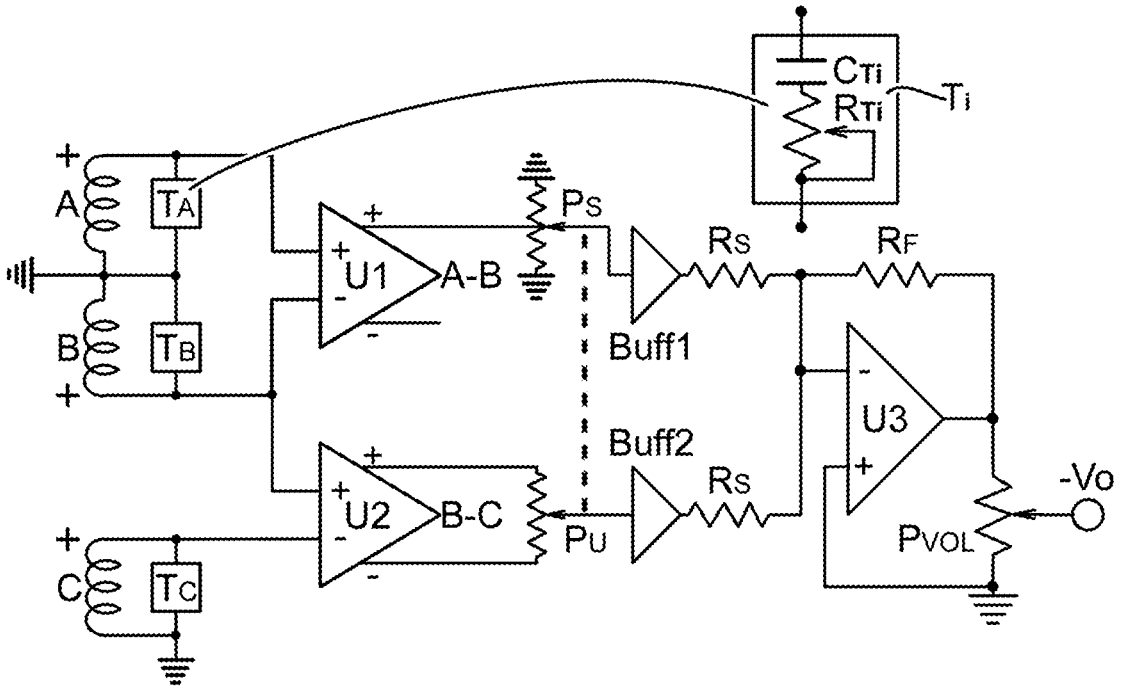

FIG. 25 shows FIG. 10 reconfigured with each sensor, A, B & C, having its own tone circuit, $T_A$, $T_B$ & $T_C$, so that resonant peaks can be used as elements of output tone, where each tone circuit Ti is comprised of a tone capacitor, $C_T$i, in series with a variable resistor, $R_T$i.

DESCRIPTION OF THE INVENTION

Principles of Operation

Matched single-coil electromagnetic guitar pickups are defined as those which have the same volume and phase response to external electromagnetic fields over the entire useful frequency range. As noted in previous PPAs, these principles are not limited to electromagnetic coil sensors, but can also be extended to hall-effect sensors responding to electromagnetic fields, and to capacitive, resistive strain and piezoelectric sensors responding to external electric fields. For example, if two piezo sensors are placed on a vibrating surface so that they react to two different bending modes on the instrument, and mounted so that the grounded electrodes are facing the same hum signal source, then the interference is both shielded, and cancelled as a common-mode voltage in the differential amplifier, and the paired signal output is the difference of the two bending modes.

Humbucking Basis Vectors

Let A and B denote the signals of two matched single-coil pickups, A and B, which both have their north poles up, toward the strings (N-up). To produce a humbucking signal, they must be connected contra-phase, with an output of A−B. It could be B−A, but the human ear cannot generally detect the difference in phase without another reference signal. Conversely, if A and $\underline{B}$ denote two matched pickups where A is N-up and the underscore on $\underline{B}$ denotes S-up, or south pole up, then the only humbucking signal possible is A+$\underline{B}$. Any gain or scalar multiplier, s, times either signal, A−B or A+$\underline{B}$, can only affect the volume, not the tone.

Bu t as soon as a third pickup is added, the tone can be changed. Let N, $\underline{M}$ and B denote the signals of matched pickups N, $\underline{M}$ & B a 3-coil electric guitar. Let N be the N-up neck pickup, $\underline{M}$ be the S-up middle pickup, and B be the N-up bridge pickup. A typical guitar with a 5-way switch has the outputs, N, (N+$\underline{M}$)/2, $\underline{M}$, ($\underline{M}$+B)/2 and B, where the summed connections are in parallel. Math 1a&b show two possible forms of humbucking basis vectors, used to combine the signals N, $\underline{M}$ & B with the scalar variables s and u.

$$Vo = [N\ \underline{M}\ B]\begin{bmatrix}1 & 1\\ 1 & 0\\ 0 & -1\end{bmatrix}\begin{bmatrix}s_1\\ u_1\end{bmatrix} \qquad \text{Math 1a}$$

$$Vo = s_1(N+\underline{M}) + u_1(N-B) = (s_1+u_1)N + s_1\underline{M} - u_1 B,$$

basis equation.

$$Vo = [N\ \underline{M}\ B]\begin{bmatrix}10\\ 11\\ 01\end{bmatrix}\begin{bmatrix}s_2\\ u_2\end{bmatrix} \qquad \text{Math 1b}$$

$$Vo = s_2(N+\underline{M}) + u_2(\underline{M}+B) = s_2 * N + (s_2+u_2) * \underline{M} + u_2 * B,$$

basis equation.

Math 1a uses the basis vectors [1,1,0] and [1,0,−1], and Math 1b uses the basis vectors [1,1,0] and [0,1,1]. Note that two basis vector sets are linearly dependent, that [1,1,0]−[1,0,−1]=[0,1,1]. The scalar vectors [$s_1$,$u_1$] and [$s_2$,$u_2$], contain the scalar multipliers, $s_1$ & $u_1$ and $s_2$ & $u_2$, which can be considered rectangular coordinates in SUV-space, where the S, U & V denote the successive humbucking pair scalars, s, u, v, et cetera. Note that the SUV-space with coordinates [$s_1$,$u_1$] maps into the SUV-space with coordinates [$s_2$,$u_2$] with the linear transformation in Math 2. So the two spaces cover all the same humbucking tones.

$$s_2 = s_1 + u_1,\ u_2 = -u_1 \qquad \text{Math 2.}$$

Constructing Tables of Relative Amplitudes and Moments for all Circuits from the Simultaneous FFT Spectra of a Few The Fast Fourier Transform, or FFT, is linear. If X(f) and Y(f) are the respective complex Fourier transforms of x(t) and y(t), and exist, then Math 3 holds true.

$$a*x(t)+b*y(t) \Leftrightarrow a*X(f)+b*Y(f) \qquad \text{Math 3.}$$

Likewise, the Fourier transforms of the signals in Math 1 are linear. For example, the circuit produced by this switching system is N1*o*N2S2, in the notation used here, and the signals from the coils in that circuit are n1(*t*), n2(*t*) and s2(*t*), with Fourier transforms N1(*f*), N2(*f*) and S2(*f*), then Math 4 holds true via Math 1 and Math 3.

$$n1(t)-[n2(t)-s2(t)]/2 = n1(t)+[s2(t)-n2(t)]/2$$

$$\Leftrightarrow$$

$$N1(f)+[S2(f)-N2(f)]/2 \qquad \text{Math 4.}$$

There are at least 3 forms of the frequency components of the Fourier transform; a cosine paired with a sine; a magnitude paired with a phase; and a real part paired with an imaginary part. From the form with real and imaginary parts of a frequency component $Z(f_j)=X(f_j)+iY(f_j)$, the magnitude and phase can be easily constructed, as shown in Math 5.

$$x(t) \Leftrightarrow X(f),\ y(t) \Leftrightarrow Y(f),\ z(t) \Leftrightarrow Z(f) \qquad \text{Math 5}$$

$$Z(f_i) = X(f_i) + jY(f_i), \text{ where } j^2 = -1$$

$$\text{Magnitude } Z(f_i) = |Z(f_i)| = \sqrt{X(f_i)^2 + Y(f_i)^2}$$

$$\text{Phase } Z(f_i) = \arctan\left(\frac{Y(f_i)}{X(f_i)}\right).$$

This means that however the strings can be excited to provide signals from each and every matched pickup coil being used, the simultaneous signals from each coil can be sampled and individually transformed into complex Fourier series. Often, the signals are sampled and digitized at high rates in sequence, so there is a finite time delay between samples for different coils. Equation (3-20) in Brigham (1974) shows how to compensate for this, as shown in Math 6, where $t_o$ is the time delay between samples.

$$x(t-t_0) \Leftrightarrow X(f)*e^{-j2\pi f\,t_0}, e^{-j2\pi f\,t_0} = \cos(2\pi f\,t_0) - j\sin(2\pi f\,t_0) \quad \text{Math 6.}$$

As a practical matter, sampling and digitizing rates can be 48 k-Samples/s or higher. To obtain a frequency spectrum for 0 to 4 kHz, one must sample and digitize at 8 kS/s, which leaves room for sampling 6 signals in sequence at 48 kS/s. If an acceptable phase error is 1 degree, or 0.1745 radian at 4 kHz, then the clock measuring $t_0$ must be accurate to 1/(360*4000 Hz)=0.694 uS. Since it takes a few clock cycles of a microcontroller or microprocessor to mark a time, this suggests the need for a system clock of that many clock cycles times 1.44 MHz, or greater.

The complex series for the coils can be added, subtracted, multiplied and divided according to equation via Math 2 for each and every circuit combination this switching system (or any other switching system) can produce. Then, for every frequency component of every given complex Fourier transform for every circuit, the magnitude of that component can be obtained via Math 6 and substituted into Math 1 to obtain the relative signal amplitude and frequency moments for that circuit and excitation.

That means it is not necessary to run an FFT process for every single point in SUV-space. It can all be done by computation from the FFTs either for each pickup coil or for each humbucking pair. Baker (2017) determined that for J number of matched pickup coils, there could only be J−1 number of independent basis vectors for humbucking pairs. This means that in order to obtain the individual signals of individual coils from humbucking pairs, triples, etc., at least one of the coil signals must be independently measured. It does not matter which coil is measured independently, so long as it is placed alone across whatever output feeds into the sampling input, with a proper ground reference. This could be as simple as a switch shorting out one of the coils in a humbucking pair. This would require the use of SW1 in FIG. 23, for example.

Analog Circuit Simulations of Humbucking Basis Vectors

Figure 1A:
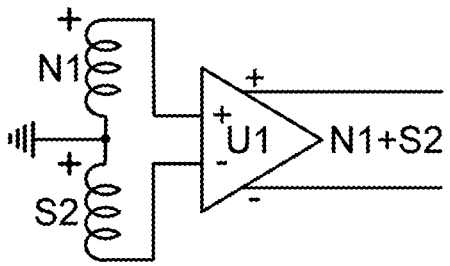
FIGS. 1A-B show how humbucking pairs of matched single-coil pickups, or dual coil humbuckers, with opposite poles up (N1, S2 in 1A) and with the same poles up (N1, N2 in 1B) connect to differential amplifiers (U1 in 1A, U2 in 1B) to produce humbucking signals (N1+S2 in 1A; (N1−N2 in 1B).
Figure 1B:
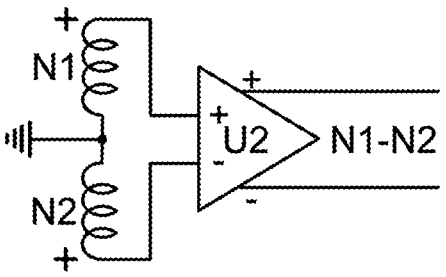

FIG. 1 shows analog circuits simulating humbucking basis vectors for two matched single-coil pickups. It borrows from the common connection point switching circuits in Non-Provisional patent application Ser. No. 16/139,027 (Baker, 2018 Sep. 22, U.S. Pat. No. 10,380,986, 2019). In that system, the pickup coils are all connected to the same point in the switching circuit, so that the hum voltages connected to that point all have the same phase. Then when the other ends of the coils are connected to the plus and minus inputs of a differential amplifier, U1 in FIG. 1A, and U2 in FIG. 1B, the hum voltages cancel at the differential amplifier output. The only thing that sets the phase of the vibration signal is the orientation of the magnetic field. The connections are such that when the field is North-up (N-up), the coil end at the amplifier input has a nominally positive signal phase, and when it is S-up, the coil end connected to the amplifier has a negative signal phase. FIG. 1A shows a N-up pickup in the 1-position, and a S-up in the 2-position, producing an output signal of N1+S2. FIG. 1B shows an N-up pickup in each position, producing an output signal of N1−N2. Note that if the pickups switched position in FIG. 1A, the output signal would be −S1−N2=−(S1+N2). This is the same as N1+S2 by the Rule of Inverted Duplicates, meaning that if the vibration signal is reversed in phase or connections as the output, the human ear cannot tell the difference, because there is no other reference. It could only make a possible difference if some part of the analog signal path, including the ear, has a sufficiently large non-symmetrical non-linearity.

This approach can be extended to any number of matched pickups. FIG. 2 shows 3 coils from matched pickups, A, B and C, each connected one terminal to ground that the other to the inputs of differential amplifiers U1 or U2, with outputs A−B and B−C, that same designations being used for both the coils and their signals. FIG. 3 shows 4 coils from matched pickups, A, B, C and D, each wired in similar fashion to differential amplifiers, U1, U2 and U3, with outputs A−B, B−C and C−D. The plus signs on the coils show the polarity of the hum voltage, which is canceled at every output, making all the outputs humbucking. Any linear mixture of the outputs, then, is also humbucking.

If the pickup at A is N-up, and designated Na, then its vibration signal has a positive sign, +Na. If it is S-up, and designate Sa, then its vibration signal has a negative sigh, −Sa. Tables 1 and 2 show the maximum possible number of different pole/position configurations for FIGS. 2 and 3, with 4 and 8 configurations, respectively. If the B coil is S-up and the C coil is N-up, then the B−C output signal is −Sb−Nc. If B is N-up and C is S-up, then the B−C output signals is Nb+Sc. By the Rule of Inverted Duplicates, these are the same in-phase tones. It does not matter whether a coil in a given position is S-up or N-up, it will still have the same harmonic content, just opposite phases. So −Sb−Nc=−(Sb+Nc) is an in-phase signal of opposite polarity to the in-phase signal with the same harmonic content, Nb+Sc, assuming a linear system.

TABLE 1

Outputs for FIG. 2 with four possible pole/position configurations, where Σ tones are in-phase and Δ tones are contra-phase

| pole config | A | B | C | A-B | B-C | s | u |
|---|---|---|---|---|---|---|---|
| N,N,N | Na | Nb | Nc | Na-Nb | Nb-Nc | Δ1 | Δ2 |
| S,N,N | -Sa | Nb | Nc | -Sa-Nb | Nb-Nc | -Σ1 | Δ2 |
| N,S,N | Na | -Sb | Nc | Na+Sb | -Sb-Nc | Σ1 | -Σ2 |
| N,N,S | Na | Nb | -Sc | Na-Nb | Nb+Sc | Δ1 | Σ2 |

Or to look at it another way, there are two difference tones, Δ1 and Δ2, and two sum tones, Σ1 and Σ2, with the additions −Σ1 and −Σ2, which are inverse duplicates. Any of the minus signs can be replaced by changing the sign of one or both scalars, s and u. Note that using N,S,S in the second row, instead of its inverse duplicate, S,N,N, would replace (−Σ1, Δ2) with (Σ1,−Δ2), which will produce exactly the same output tones of Vo=s(A−B)+u(B−C), merely be reversing the signs of s and u. The only true differences are the combinations of in-phase (Σ) and contra-phase (Δ) tones, (Δ,Δ), (Δ,Σ), (Σ,Δ) and (Σ,Σ). Each combination navigates a different tonal/amplitude space with values s and u.

TABLE 2

Outputs for FIG. 3 with eight possible pole/position configurations

| Pole Config | A | B | C | D | A-B | B-C | C-D | s | u | v |
|---|---|---|---|---|---|---|---|---|---|---|
| N,N,N,N | Na | Nb | Nc | Nd | Na-Nb | Nb-Nc | Nc-Nd | Δ | Δ | Δ |
| S,N,N,N | -Sa | Nb | Nc | Nd | -Sa-Nb | Nb-Nc | Nc-Nd | -Σ | Δ | Δ |
| N,S,N,N | Na | -Sb | Nc | Nd | Na+Sb | -Sb-Nc | Nc-Nd | Σ | -Σ | Δ |
| N,N,S,N | Na | Nb | -Sc | Nd | Na-Nb | Nb+Sc | -Sc-Nd | Δ | Σ | -Σ |
| N,N,N,S | Na | Nb | Nc | -Sd | Na-Nb | Nb-Nc | Nc+Sd | Δ | Δ | Σ |

TABLE 2-continued

Outputs for FIG. 3 with eight possible pole/position configurations

| Pole Config | A | B | C | D | A-B | B-C | C-D | s | u | v |
|---|---|---|---|---|---|---|---|---|---|---|
| S,S,N,N | -Sa | -Sb | Nc | Nd | -Sa+Sb | -Sb-Nc | Nc-Nd | -Δ | -Σ | Δ |
| S,N,S,N | -Sa | Nb | -Sc | Nd | -Sa-Nb | Nb+Sc | -Sc-Nd | -Σ | Σ | -Σ |
| S,N,N,S | -Sa | Nb | Nc | -Sd | -Sa-Nb | Nb-Nc | Nc+Sd | -Σ | Δ | Σ |

In Table 2, the same principles apply. From Non-Provisional patent application Ser. No. 15/917,389, we have that for K number of matched and reversible magnetic sensors, there are $2^{K-1}$ possible unique magnetic pole reversals, assuming a linear signal system and the Rule of Inverted Duplicates. For four pickups, there are $2^{4-1}=2^3=8$ pole configurations. As we see here, this metric also holds true for the number of configurations of in-phase (Σ) and contra-phase (Δ) tones associated with the humbucking basis vector scalars, s, u and v. If Δ is taken for a binary 0 and Σ is taken for a binary 1, the results of the 8 pole configurations can be ordered from (4,4,4) or (0,0,0) to (Σ,Σ,Σ) or (1,1,1).

The only difference in warmness or brightness of tone between serial and parallel circuits comes from the load impendence on the output of the circuit, and the load impedance of a solid-state differential amplifier, as shown in FIGS. 1-3, is very high, with little effect on the pickups. FIG. 4A shows two matched pickup in series, with signal voltages $V_A$ and $V_B$, and both with coil impedances, Z, with an output, Vo, into a load impedance, $Z_L$. The signal voltage polarities match two N-up pickups and the hum voltages. As before, the signal polarity reverses when the pickup is changed to S-up. FIG. 4B shows the same two matched pickups connected in parallel, with the same load impedance.

$$\frac{Vo}{Z_L}+\frac{Vo-V_A+V_B}{2Z}=0\Rightarrow Vo=\frac{(V_A-V_B)Z_L}{2Z+Z_L}\Big|_{ZL\to\infty}=V_A-V_B. \quad \text{Math 7a}$$

$$\frac{Vo-V_A}{Z}+\frac{Vo+V_B}{Z}+\frac{Vo}{Z_L}=0\Rightarrow Vo=\frac{(V_A-V_B)Z_L}{2Z_L+Z}\Big|_{ZL\to\infty}=\frac{(V_A-V_B)}{2}. \quad \text{Math 7b}$$

Math 7a shows the circuit equation and output solution for FIG. 4A, and Math 7b shows the same kind of analysis for FIG. 4B. Taking the solution equations as $Z_L$ goes to infinity approximates putting a differential amplifier on the outputs of the circuits in FIG. 4. The only difference is a factor of ½ in the output. When $V_A=V_B=$Vhum, Vo cancels to zero, making the circuits humbucking pairs. These are the trivial cases where there is only one humbucking basis vector and one multiplying scalar, s.

FIGS. 5A&B show two humbucking triples, consistent with Table 1. Again, the signal voltage polarities shown correspond to either all N-up pickups, or hum voltages. The signal voltage polarities are reversed for S-up pickups. Math 8a describes the output equation for FIG. 5A. Math 8b describes the output equation for FIG. 5B.

$$\frac{Vo}{Z_L}+\frac{Vo-V_C}{Z}+\frac{Vo+V_A+V_B}{2Z}=0 \quad \text{Math 8a}$$

$$Vo=\frac{(2V_C-V_A-V_B)Z_L}{2Z+3Z_L}\Big|_{ZL\to\infty}=\frac{2V_C-V_A-V_B}{3}.$$

-continued $$\frac{Vo}{Z_L}+\frac{Vo-V_1-V_D}{Z}=0, \quad \text{Math 8b}$$

$$\frac{V_1+V_D-Vo}{Z}+\frac{V_1+V_E}{Z}+\frac{V_1+V_F}{Z}=0$$

$$Vo=\frac{(2V_D-V_E-V_F)Z_L}{3Z+2Z_L}\Big|_{ZL\to\infty}=\frac{2V_D-V_E-V_F}{2}=V_D-\frac{V_E+V_F}{2}.$$

$$Vo=[A\ B\ C]\begin{bmatrix}1&0\\-1&1\\0&-1\end{bmatrix}\begin{bmatrix}s\\u\end{bmatrix}=s^*(A-B)+u^*(B-C) \quad \text{Math 9}$$

$$Vo=s^*A+(-s+u)^*B-u^*C, \text{ basis equation.}$$

Letting A, B and C stand in for the voltages, $V_A$, $V_B$ and $V_C$, Math 9 expresses the humbucking basis vectors and output basis equation which will apply to both circuits in FIG. 5 for all N-up pickups. If any of A, B, or C are replaced by an S-up pickup, the sign before it is reversed, as in Table 1. For FIG. 5A, Vo=−A/3−B/3+2C/3, which is satisfied by (s,u)=(−⅓,−⅔). For FIG. 5B, replacing D, E and F with A, B and C, Vo=A−B/2−C/2, which is satisfied by (s,u)=(1,½). Without further proof, we can submit the conjecture that every humbucking circuit in Non-Provisional patent application Ser. No. 15/616,396 and Non-Provisional patent application Ser. No. 16/139,027 can be represented this way, with humbucking basis vectors, simulated by circuits like those in FIG. 1-3, and output basis equations, simulated by multiplying scalars times the difference voltages, A−B, B−C, C−D, etc.

Embodiment 1: Humbucking Variable Gain Circuit for 3 Matched Pickups

FIG. 6 shows a 3-coil analog circuit simulating humbucking basis vectors to produce a humbucking output with variable gains. It extends FIG. 2 by adding potentiometers, $P_S$ and $P_U$, simulating the scalars s and u, each buffered by unity gain amplifiers, Buff1 and Buff2, feeding into summing resistors, $R_S$. The summing resistors feed a negative-gain op-amp circuit, U3 and $R_F$, which drive a volume pot, $P_{VOL}$, connected to the output, −Vo. Power supply and tone control are not considered. The gain of the U3 circuit is $-R_F/R_S$. If the gains of the differential amplifiers, U1 an U2, are G1=G2=G, then the range of the scalar pots in terms of the scalars are −G/2≤s,u≤G/2, and the output voltage, Vo, is Vo=$-R_V$*((A−B)*s+(B−C)*u)*$R_F/R_S$, where $R_V$ is the output ratio of the pot $P_{VOL}$. $P_S$ and $P_U$ are assumed to turn clockwise from −G/2 to +G/2, but the minus sign on the output voltage, −Vo, can reversed merely by reversing the end terminals on the pots. FIG. 3 can be extended the same way, with 3 pots, $P_S$, $P_U$ and $P_V$, 3 buffers and 3 summing resistors.

Embodiment 2: Ganged Sine-Cosine Pots in Humbucking Amplifiers

Note that if the pots Ps and Pu in FIG. 6 are linear, then at the midrange points on the pots, s=u=0, with Vo=0. If the pots are linear and set independently, s and u can range independently over an entire (s,u)-space (or SU-space) with boundaries of ±G/2. In this case, the output signal can vary widely in amplitude for the same tone, where s/u is a constant, and produce the same tone on the other side of the SU-space origin, where the output signal is merely inverted.

But if the pots have a 360-degree sine taper for Pu and a cosine taper for Ps, as shown in FIG. 7, then there is always a signal output at Vo. When one pot sits at zero output, the other sits at plus or minus 1. In this arrangement, the wipers must be synchronized at 90 degrees (pi/2) out of phase in rotation. This also has the advantage of maintaining a relatively equal level of amplitude, since the plot of (s,u) describes a circle of fixed radius about the SU-space origin. Then the amplitude will vary only according to the relative signal outputs of each pickup and the cancellation of phases between them. FIG. 8 shows how 360-degree rotation sine and cosine pots traverse SU-space.

Figure 9C:
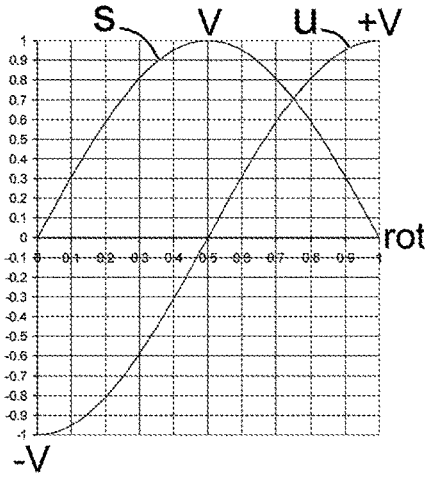
Figure 9D:
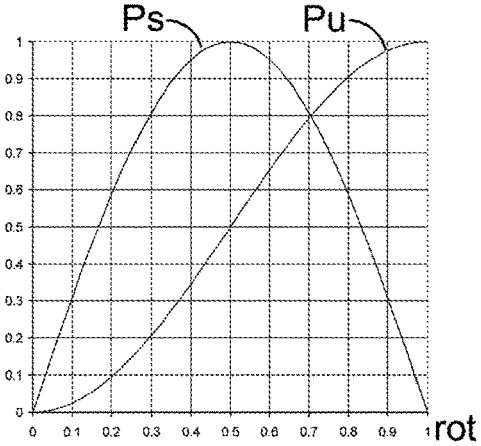

But for any two points in SU-space, (s1,u1) and (s2,u2), where s2=−s1 and u2=−u1, one output, Vo, will merely be the opposite sign, −Vo, of the other. These will be indistinguishable in a linear signal system. So half of SU-space is not needed. Instead of being very expensive 360-degree rotation pots, Ps and Pu can be more ordinary pots with a half-cycle of cosine and sine each, still expensive, but less so. FIG. 9 shows half-wave cosine and sine pots and their functions. In FIG. 9A, a cosine-taper pot is a 4-terminal device, with voltage fed to a center-tap, and ends of the pot resistance taper grounded. FIG. 9B shows a sine-taper pot, with the ends connected to −V and +V. FIG. 9C shows half-cycles of s=cos(θ) and u=sin(θ) shifted onto a graph where the horizontal axis is the fractional rotation of a single-turn pot, such that rot*π=θ+π/2. FIG. 9D shows those curves pot tapers, in terms of voltage at the wiper plotted on fractional pot rotation. FIG. 10 shows a modified FIG. 6, with those pots in place.

$$(\ldots((((\cos^2\theta_1+\sin^2\theta_1)\cos^2\theta_2+\sin^2\theta_2)\cos^2\theta_3+\sin^2\theta_3)\ldots)\cos^2\theta_j+\sin^2\theta_j)=1 \qquad \text{Math 10a.}$$

$$(\cos^2\theta_1+\sin^2\theta_1)\cos^2\theta_3+(\cos^2\theta_2+\sin^2\theta_2)\sin^2\theta_3=1 \qquad \text{Math 10b.}$$

The trig identity in Math 10a can be used to extend FIG. 10 to any number of pickups or sensors, as FIG. 11 shows. Math 10b shows a different and valid arrangement of terms for four humbucking pair signals. Any set of orthogonal functions can be used to vary the scalar SU-space scalars, s, u, v, q, . . . , so long as the sum of their squares can be scaled to 1. But sine and cosine are often the most convenient to use and understand.

In FIG. 11, using Math 10a, the differential amplifiers, U1, U2 and U3 are set to have a gain of 2. The two gangs of $P_1$, $P_{1S}$ and $P_{1U}$, act as the multipliers, s=cos($\theta_1$) and u=sin($\theta_1$), to produce the signals, (A−B)cos($\theta_1$) and (B−C)sin($\theta_1$). They are summed through the unity-gain bufferens, Buff1 and Buff2, and summing resistors, $R_S$, in Buff3 and fed to the cosine-taper gang of pot $P_2$, $P_{2\ COS}$, forming the signal [(A−B)cos($\theta_1$)+(B−C)sin($\theta_1$)]cos($\theta_2$). The sine-taper gang of $P_2$, $P_{2V}$, simulates v=sine($\theta_2$), to produce the signal (C−D)sin($\theta_2$). The last two signals feed through Buff4 and Buff5, and summing resistors, $R_S$, into the amplifier circuit, U4 and $R_F$. This produces the signal, Vo=−{[(A−B)cos($\theta_1$)+(B−C)sin($\theta_1$)]cos($\theta_2$)+(C−D)sin($\theta_2$)}$R_F/R_S$. If the basic sensor amplitudes of (A−B), (B−C) and (C−D) are equal, this describes a half-sphere in the 3-space (s,u,v), where those rectilinear coordinates are translated to spherical coordinates ($\theta_1$,$\theta_2$,amplitude), where amplitude$^2$ is equal to $|A-B|^2+|B-C|^2+|C-D|^2$. The volume pot, $P_{VOL}$, then reduces this signal to the output, −Vo.

There is another advantage to doing it this way. Using the trig identity removes one degree of freedom from the equations. So for J number of matched single-coil pickups, there are J−1 humbucking pair signals and J−2 controls, s, u, v, . . . . This means that for a 3-coil guitar, only one rotary control needs to be used to set the tone (but not the volume) over the entire range from bright to warm. For a 4-coil guitar, or 2 dual-coil humbuckers used as 4 matched coils, just 2 rotary controls can move the tone over the entire half-sphere of tonal changes. But it is not usually possible for such a manual control to move monotonically from "bright" to "warm", as those terms are very subjective in human hearing, and the phase cancellations providing "bright" tones can happen in the middle of the pot rotation range. Getting a continuous range from "bright" to "warm" will require more research both to provide measurable and acceptable scientific definitions of those terms, which can be calculated, sorted and controlled by digital processors.

Embodiment 3: Ganged Pseudo-Sine Pots in Humbucking Amplifiers

Unfortunately, sine-cosine pots tend to be either large or expensive or both. But sine and cosine are not the only functions for which $(s(x)^2+u(x)^2)=1$, where $0\le x\le 1$ is the decimal fractional rotation of a single-turn pot with multiple gangs, having tapers s(x) and u(x). One of these functions can be simulated with a 3-gang linear pot. FIG. 12 shows this circuit applied to FIG. 10. The linear pot gang, Pgc, of pot Pg in FIG. 12 replaces the sine-taper pot in FIG. 10, Pu, and simulates the scalar u in Math 9. The differential amplifiers, U1 and U2 are assumed to have a gain of 2. The circuit comprised of the resistor, $R_B$, and the two linear gangs, Pga and Pgc, of pot Pg, of resistance value, Rg, replaces the cosine-taper pot, Ps. The plus output of U1, Vc, is modified by the 2-gang pot circuit on the wiper terminal as Vw, which is ½ the voltage divider output, $V_1$. The combination of the resistor, $R_B$, the 2-gang circuit and the Buff1 with gain, G, simulates the scalar, s, in Math 9, as shown in Math 11.

$$\frac{V_1}{Vc}=\frac{2x(1-x)Rg}{2x(1-x)Rg+R_B}, \qquad \text{Math 11}$$

$$Vw=\frac{V_1}{2}$$

$$\frac{V_1}{Vc}\Big|_{x=1/2}=\frac{Rg}{Rg+2R_B},$$

$$\text{For } G\frac{V_1}{Vc}\Big|_{x=1/2}=1\rightarrow G=\frac{Rg+2R_B}{Rg}$$

$$G\frac{V_1}{Vc}=s(x)=\frac{2x(1-x)(Rg+2R_B)}{2x(1-x)Rg+R_B}.$$

Math 11 shows the solutions to the circuit equations for $R_B$, Pga, Pgb, Vs, $V_1$ and Vw. In order for the simulation of the scalar, s, to have a range from 0 to 1, the gain, G, of Buff1 must be as shown. As noted in FIG. 12, the output of Buff1 simulates s(A−B) and the output of Buff2 simulates u(B−C). If the humbucking pair amplitudes are equal, V=A−B=B−C=1, then FIG. 13 shows the plots of s(x), u(x) and RSS=$(s^2(x)+u^2(x))^{1/2}$, as the functional tapers of the pseudo-cosine circuit and the linear Pgc with pot fractional rotation, x. Given the resistance value the gangs of the pot Pg, Rg, the value of $R_B$ is changed by optimization until e is minimized in Math 12. Then G is set in Math 11. For example, when Rg=10 k and $R_B$=2.923 k, ε optimizes to ±0.0227, or less than 3% of scale.

$$1-(s^2(x)+u^2(x))\le\pm\varepsilon \qquad \text{Math 12.}$$

FIG. 14 shows a half-circle plot of 51 points from FIG. 13 of s plotted against u, from x=0 to 1, in 0.02 steps. Note that the center of the range, around x=0.5, has more resolution than for x=0 or x=1, due to matching a linear curve, u(x), with a non-linear curve, s(x).

Embodiment 4: Approximating Sine-Cosine Pots with Linear Digital Pots

FIG. 15 shows FIGS. 10 & 12 with the analog pots replaced by digital pots, $P_S$ and $P_U$, with 3-line digital serial control lines going to a micro-controller (uC), not shown. The fully-differential amplifiers, U1 & U2, each have a gain of 2 and the buffers, Buff1 and Buff2 each have a gain of 1, providing and simulating signals s(A−B) and u(B−C) in concert with $P_S$ and $P_U$. The micro-controller calculates the appropriate cosine (for Ps) and sine (for Pu) functions, and uploads them into the digital pots via the serial control lines. Depending on make and model, digital pots typically come with 32, 100, 128 or 256 resistance taps, linearly spaced to provide a total resistance across the pot of typically 5 k, 10 k, 50 k or 100 k-ohms.

For this example, we will assume digital pot with 256 resistance taps. In this case, x as a decimal fractional rotation number from 0 to 1 has no meaning. The numbers 0 and 255 correspond to the ends of the pot, zero resistance to full resistance on the wiper. The internal resistor is divided into 255 nominally equal elements, and an 8-bit binary number, from 00000000 to 11111111 binary, or from 0 to 255 decimal, determines which tap is set. The pot either has a register which holds the number, or an up-down counter which moves the wiper up and down one position. The convention used here makes s=cos(θ) and u=sin(θ) for −π/2≤θ≤π/2, with 0≤s≤1 and −1≤u≤1. So s maps onto 0≤Ns≤255, and u maps onto 0≤Nu≤255. This breaks each of s=cos(θ) and u=sin(θ) into 256 discrete values, from 0 to 1 for s and from −1 to 1 for u. So the resulting sin and cosine plots are non-continuous. The number that is fed to the pot to set it must be an integer from 0 to 255. Math 13 shows how this number is set, given that the uC has sine and cosine math functions. The value of 0.5 is added before converting to an integer to properly round up or down. The resulting error in Math 12 tends to be ±1/255.

$$\mathrm{Int}(y)=\mathrm{integer}\le y$$

$$Ns=\mathrm{Int}(255s+0.5)=\mathrm{Int}(255\cos(\theta)+0.5)$$

$$Nu=\mathrm{Int}(127.5*(1+u)+0.5)=\mathrm{Int}(127.5*(1+\sin(\theta))+0.5) \qquad \text{Math 13.}$$

Embodiment 5: Pseudo-Sine Approximation with Linear Digital Pots

Unfortunately, not all micro-controllers come with trig functions in their math processing units. One very low power uC, which runs at about 100 uA (micro-amps) per MHz of clock rate, has 32-bit floating point arithmetic functions, including square root, but no trig functions or constant of Pi. This requires two different orthogonal functions which can satisfy Math 12, but not necessary those in Embodiment 3. Math 14 shows a set of functions, s(x) and u(x), which meet Math 12 with no error, and are orthogonal to each other. FIG. 16 shows s(x) and u(x) in the solid lines, and cos(θ) and sin(θ) for θ=π(x−½) as the dotted lines. The differences between s and cos(θ) runs from 0 to 0.056, and the differences between u and sin(θ) run from about −0.046 to +0.046.

$$\mathrm{Int}(y)=\mathrm{integer}\le y \qquad \text{Math 14}$$

$$s=1-4\left(x-\frac{1}{2}\right)^2,$$

$$u=\begin{cases}-\sqrt{1-s^2}, & 0\le x<\frac{1}{2}\\ +\sqrt{1-s^2}, & \frac{1}{2}\le x\le 1\end{cases}$$

$$Ns=\mathrm{Int}(255s+0.5)$$

$$Nu=\mathrm{Int}(127.5*(1+u)+0.5).$$

FIG. 17 shows Ns and Nu from Math 14 for 51 values of x in steps of 0.02 from 0 to 1. These are a kind of pot-taper plot. Note that for x=0.5, Ns=255 and Nu=128. The errors should be on the order of 1/255, plus the digital pot manufacturing errors. FIG. 18 shows the s versus u half-circle plot for the same 51 values of x. Note that the distribution of points on the circle does not bunch like those for the pseudo-cosine-sine analog plot curves in FIG. 14. This is a much closer approximation to sine-cosine curves and is actually cheaper in digital pot part costs than analog potentiometers, not counting the circuit and uC costs.

$$0\le x<1,\ \theta(x)=\pi(x-0.5) \qquad \text{Math 15}$$

$$s=1-5\left(x-\frac{1}{2}\right)^2+4\left(x-\frac{1}{2}\right)^4,$$

$$u=\begin{cases}-\sqrt{1-s^2}, & 0\le x<\frac{1}{2}\\ +\sqrt{1-s^2}, & \frac{1}{2}\le x\le 1\end{cases}.$$

Math 15 shows an even better function, plotted in FIG. 19, for x=0 to 1 in steps of 0.01. The error for s(x)−cos(θ(x)) runs from 0 to −0.067 and for u(x)−sin(θ(x)) from −0.004 to +0.004. The functions s and u in Math 15 are orthogonal and meet Math 12 with no error.

Embodiment 6: Pseudo-Sine Pot Functions Adapted for FFT Algorithm

The functions in Math 14 & 15 suggest the candidates in Math 16 & 17 to be substituted for sine and cosine in an FFT algorithm, when the uC has a floating point square root function, but no Pi constant or trig functions. In these cases, the variable of rotation is not 0≤θ<2π, but 0≤x<1; the frequency argument of cosine changes from (2πft) to simply (ft), and the FFT algorithm must be adjusted to scale accordingly. FIG. 20 shows the plots for x=0 to 1.5, step 0.01. The error in Sxm−sin is −0.00672 to 0.00672 and the error in Cxm−cos is −0.004 to 0.004. Note how the scaling has changed between Math 15 & 16 from (x−0.5) to (2x−0.5), which is necessary to fit a full cycle into 0≤x<1.

$$xm = x\ modulo\ 1, \qquad \text{Math 16}$$

$$\theta(x)=2\pi x$$

$$\sin(\theta(x))\approx S_{xm}=\begin{cases}0\le xm\le 0.5, & 1-5(2^*xm-0.5)^2+4(2^*xm-0.5)^4\\ 0.5<xm<1, & -(1-5(2^*xm-15)^2+4(2^*xm-15)^4)\end{cases}$$

$$\cos(\theta(x))\approx C_{xm}=\begin{cases}0.25<xm<0.75, & -\sqrt{1-Sxm^2}\\ \text{else}, & \sqrt{1-Sxm^2}\end{cases}.$$

-continued $$xm = x \text{ modulo } 1,$$
$$xm2 = xm \text{ modulo } 0.5$$
$$a = (xm2 - 0.25)^2$$
$$S_{xm} = \begin{cases} 0 \le xm \le 0.5, & b_1^* a + b_2^* a^2 - b_3^* a^3 \\ 0.5 < xm < 1, & -(b_1^* a + b_2^* a^2 - b_3^* a^3) \end{cases}$$
$$S_{xm} \leftarrow S_{xm} + S_{xm-corr}. \qquad \text{Math 17}$$

where $b_1$=0.2629467, $b_2$=0.7071068, $b_3$=78.62807 are optimized to reduce some measure of error between $S_{xm-corr}$ and Sine Math 17 shows an added correction to Sxm, prior to calculating Cxm, which reduces the error to less than ±1.5e-6 for Sxm, and less than ±1.4e-5 for Cxm. The precision of the coefficients is consistent with IEEE 754 32-bit floating point arithmetic. Listing 1 shows a Fortran-like subroutine to calculate the sine- and cosine-approximation return variables SXM and CXM from X and NORD. For NORD=0, a re-scaled Match 14 is calculated, for NORD=1, Math 16 is calculated, and for NORD=2, the correction in Math 17 is added before calculating CXM.

Listing 1: Fortran-like subroutine to calculate Math 14-17 for a full cycle

```
SUBROUTINE SUDOSC (X, SXM, CXM, NORD)
  REAL X(1), SXM(1), CXM(1)
  INTEGER NORD(1)
  XM = X MODULO 1
  XM2 = XM MODULO 0.5
  A= 2.0*XM2-0.5
  A = A*A
  IF (NORD = 0) THEN
    SXM =1.0-4.0*A
    IF (XM <= 0.5) SXM = -SXM
  ELSEIF (NORD = 0) THEN
    SXM = 1.0-5.0*A+4.0*A*A
    IF (NORD = 2) THEN
        A = XM2-0.25
        A = A*A
        SXM = ((-78.62897*A+0.7071068)*A+0.2629467)*A+SXM
      ENDIF
  ENDIF
  IF (XM > 0.5) SXM = -SXM
  IF ((0.25<XM)AND(XM<0.75)) THEN
    CXM = -SQRT(1-SXM*SXM)
  ELSE
    CXM =S QRT (1 - S XM* S XM)
  ENDIF
RETURN
```

Embodiment 7: Micro-Controller Architecture for Humbucking Basis Vectors

FIG. 21 shows a system architecture suitable for use with a very-low-power micro-controller. It will work as well with uCs which either have trig functions or not. The PICKUPS section corresponds to FIGS. 1-3 without the differential amplifiers, being matched single-coil pickups, or the coils of dual-coil humbuckers treated as single coils, with one side of the hum signal grounded on all of them. The SUV-SPACE AMP & CNTL section corresponds to FIGS. 10-12, but with the digital pots of FIG. 15. The SUM AMP and GAIN SET sections sum up the available humbucking pair signals, that have been conditioned by the vector scalars s, u, v, . . . , and adjust the gain to equalize the weaker signals with the strongest.

FIG. 22 shows the circuit and symbol representations of commercially-available, digitally-controlled, solid-state analog switches, as previously described in the Brief description of the drawings. FIG. 23 shows one section of a preferred embodiment of those three functional blocks. The humbucking pair, A and B feed into a fully differential amplifier of gain 2, comprised of U1, U2, and the resistors $R_F$, $R_F$ and $2*R_F$. This form of differential amplifier puts virtually no load on the pickups, when the inputs are JFET or similar. For various test purposes, the solid-state 1P3T switch, SW1, can short out either pickup A or pickup B on control signals from the uC. FIG. 23 is shown as the cosine section of FIG. 15, but a sine section only needs connect the output of U2 to the low side of the digital pot, $P_{DCOS}$, which the uC would then program as a sine pot. The solid-state 1P2T switch, SW2, on a high signal from the uC, switches the output of U1 from the digital pot to an analog-to-digital converter on the uC. This allows an FFT to be calculated from the signals (A−B), A or B. If SW1 shorts B to ground, then the A/D converter will see a signal of 2*(A). This allows the FFT of pickup A alone to be calculated. Then FFT(B)=FFT(A−B)−FFT(2*A)/2, and vice versa.

The cosine pot, $P_{DCOS}$, feeds into the unitary gain buffer, BUFF1, which with summing resistor $R_S$, and similar signals from other sections (BUFF2, $R_S$, . . . ) sum together the humbucking pair signals, conditioned by the digital pots simulating the scalar coordinates, s, u, v, . . . . The feedback circuit on U3, resistor $R_F$ and digital pot $P_{DF}$, provides a gain of $-(R_F+P_{DF}(\text{set}))/R_S$, as set by the uC with the 3 lines controlling $P_{DF}$. The output of U3 then feeds the ANALOG SIGNAL COND section in FIG. 21, which contains the final volume control and any tone and distortion circuits needed. In FIG. 21, the output of FIG. 23 is shown feeding into another ADC on the uC, an alternative route, and another way to take FFTs and to test the circuit for faults. The use of digital pots in FIG. 23 has another advantage; the additional gain stages needed to accommodate Math 10, as with Buff3 and $P_{2\ COS}$ in FIG. 10, are no longer needed. The expanded terms relating to Math 10a or 10b can be calculated in the uC and applied to the digital pots directly, without any need for more digital pots downstream to correct them to make the squares of the SU-space scalar coordinates sum to one.

The uC shows 4 internal functions, one FFT section, two analog-to-digital converters, ADC, and one digital-to-analog converter, D/A. The FFT section can be a software program in the uC. Or an inboard or outboard Digital Signal Processor (DSP) can be used to calculate FFTs, or any other functional device that serves the same purpose. The D/A output feeds inverted FFTs to the ANALOG SIGNAL CONDitioning section either as audio composites of the result of the simulation of the humbucking basis vector equation, or as a test function of various signal combinations. It allows the user to understand what the system is doing, and how. It can be embodied by a similar solid-state switch to SW1 or SW2, switching the input of the ANALOG SIGNAL COND block between the outputs of the SUM AMP and the D/A.

Ideally, the uC samples time-synced signals from all the humbucking pair signals simultaneously, performs an FFT on each one, and calculates average signal amplitudes, spectral moments and other indicia, some of which are shown in Math 20. It then uses this data to equalize the entire range of possible output signals, and to arrange the tones generated into an ordered continuum of bright to warm and back. The MANUAL SHIFT CONTROL is a control input that can be embodied as anything from an up-down switch to a mouse-like roller ball, intended for shifting from bright to warm tones and back without the user knowing which pickups are used in what combination or humbucking basis vector sum.

For example, Math 18 shows a humbucking basis vector equation, for pickup A S-up and pickups B, C and D N-up, as could happen for FIG. 11. A, B, C and D also stand in for the pickup signals. Since its vibration signal is the opposite polarity of the hum signal, an S-up pickup would be connected with its minus terminal to the +side of U1, and a N-Up would be connected by its plus terminal to the −side of U1. Math 19 shows how the Fourier transforms of the humbucking pair signals add linearly to produce the Fourier transform of the output signal, Vo. Math 20 shows how the individual magnitudes of the spectral components of Vo, as determined by Math 5, are used to get the amplitude of the signal and the spectral moments.

Math 18

$$Vo = [s\ u\ v]\begin{bmatrix} -1 & -1 & 0 & 0 \\ 0 & 1 & -1 & 0 \\ 0 & 0 & 1 & -1 \end{bmatrix}\begin{bmatrix} \underline{A} \\ B \\ C \\ D \end{bmatrix} = s(-\underline{A} - B) + u(B - C) + v(C - D).$$

Math 19

$$\mathcal{V}o(s, u, v) = \mathcal{F}(Vo(s, u, v)) = s\mathcal{F}(-\underline{A} - B) + u\mathcal{F}(B - C) + v\mathcal{F}(C - D).$$

Math 20

$$V_n(f_n) = |\text{Amplitude of } \mathcal{V}o(s, u, v, \ldots) \text{ at frequency } f_n|, \quad 1 \le n \le N,$$

where $s, u, v, \ldots$ are humbucking basis vector scalars $$Amp_V = \sum_{n=1}^{N} V_n, \text{ Amplitude of the signal } Vo(s, u, v, \ldots)$$

$$P_V(f_n) = \frac{V_n}{\sum_{n=1}^{N} V_n}, \text{ Probability density function}$$

$$\text{mean.}f = \sum_{n=1}^{N} f_n * P_V(f_n), \quad \text{mean frequency of } Vo(s, t, u)$$

$$\text{2nd.moment.}f = \sum_{n=1}^{N} (f_n - \text{mean.}f)^2 * P_V(f_n)$$

$$\text{3rd.moment.}f = \sum_{n=1}^{2048} (f_n - \text{mean.}f)^3 * P_V(f_n).$$

So after the uC takes the FFTs of all the unmodified humbucking pair signals, via FIGS. 21 & 23, all the amplitudes and spectral moments, and any other measure that can be constructed from FFTs, can be calculated over the entire scalar space, (s, u, v, . . . ). And inverse FFTs can give back representative audio signals, of every spectrum calculated from Math 19, to check the audible order of the tones manually. With J number of digital pots of 256 taps, the number of possible unique tones is $256^J$. But many will be so close together as to be indistinguishable. It will still take a lot of research, experimentation and development to realize the full practical benefit of this invention. The object of this embodiment—to allow the user to choose from and shift through a continuous gradation of tones, from bright to warm and back, automatically sequenced and controlled by the uC, so that the user never needs to know just which pickup signals are used in what combinations.

Regaining Some Analog Tone Control

An ordinary electro-mechanical switching system does one thing which this system cannot do without another sub-component. It connects the tone pot and capacitor directly to the pickup circuits and allows the pickups to resonate with the tone capacitor for certain tone settings. FIG. 24 shows how this happens with a pickup having an inductance of 2H, a resistance of 5 k-ohms, and various capacitors in parallel with it, from 220 pF to 220 nF, plotted as log response in decibels (dB) against frequency in Hz. An ordinary pickup might have a natural resonance at 5 to 10 kHz. An ordinary tone capacitor might have a value of 22 nF to 47 nF, or 0.022 uF to 0.047 uF. The tone pot engages or disengages the tone capacitor with the pickup circuit according to its resistance, effectively shifting the resonance curve between the pickup circuit's natural resonance and its resonance with the tone capacitor.

This also comes with shifts in phase, which the player does not normally hear, because the standard tone pot and capacitor are normally connected in parallel with the output volume pot. But a tone pot and capacitor on the output of FIGS. 1-3, 6 & 10-12 cannot resonate with any of the pickups; it can only cause a monotonic roll-off in higher frequencies, also known as a low-pass filter. If the pickups in these Figures each have their own tone circuits, as shown in FIG. 25, this functionality in resonance comes back. Furthermore, the phase shifts caused for different values of the individual tone pots can produce different phase cancellations, possibly expanding the tonal range. In some cases, it would be as if a pickup had its magnetic poles reversed at higher frequencies. And this could not be practically mapped unless the individual pickup tone pots, $R_{Ti}$, are digital pots, controlled by the uC in FIG. 21.

Notes on the Claims

As something both underlined and struck through, this is obviously a comment not meant to be published or issued, explaining the need and purpose of a new section of the Specification. Otherwise, this is not a bad idea. Notes like this help to clarify the intent of the Claim language for any future dispute, and the USPTO should consider allowing them in some form.

Claim 1 refers to all the Figures. Note how the two sensors in FIG. 1 produce a single humbucking output the trivial case, expanded to three sensors in FIG. 2. And how in FIG. 3, an added differential amplifier is needed between the two basic circuits, but still meets the definition of a basic building block. Note especially how the basic circuit connects to the "Next Section" in FIG. 23. If those links were removed, it would still be functional, if very limited, reducing the circuit back to the trivial case in FIG. 1, with an added variable gain output amplifier.

Claim 1 has been amended from the original Claim to add limitations. The invention works best with electric guitar string vibration pickups constructed with an electrically conducting coil wrapped around one or more magnetic poles. The magnetically permeable pole structure inherently attracts unwanted external magnet fields, from sources such as 60-cycle electric motors and power lines, generally called "hum". But since the interfering source is generally much farther away than the vibrating ferro-magnetic guitar strings, it tends to be about the same strength at all the guitar pickups. Therefore the pickup coils, whether the coils of a dual-coil humbucking pickup, or the coils of single-coil pickups matched in response to hum, can be wired together to significantly cancel the hum at the output of the pickup circuit. The differences in pickup string vibration output among the pickups generally come from the polarity of the magnetic source field or the positioning of the pickup near or along the string vibration.

Other types of vibration sensors, such as piezoelectric, light-sensitive, and others, which respond equally to some unwanted external signal, such as electric sources, light sources or gravimetric sources, can benefit from the same approach, if perhaps to a different extent. Claim 1.*a* has been amended with greater limitations to illustrate what types of sensors may benefit. Claim 1.*c* clarifies that if different types of sensors, or just different types of electromagnetic guitar pickup, are used on the same stringed instrument, or other device which can benefit, they cannot be interconnected with the building blocks of different sensors. In other words, if sensors A & B are one type in FIGS. 3 & 11, and C & D are another type, the "B−C" humbucking pair signal is not advisable. It will likely not work. All the A−B type signals must sum together separately after the variable gains, and all the C−D type signals must sum together separately after the variable gains, before they can be summed together in the final summing circuit near the output.

While this basic circuit is very simple, to one's knowledge it has not been applied in this field for the purpose of simulating "humbucking basis vectors", so as to remove the limitations of mechanical switching from guitar pickup circuits, especially for circuits with more than 3 coils. Other applications of this approach may yet be found in other fields.

For example, if for J=5 the circuit uses sensors A, B, C, D and E, all the possible switched humbucking pair combinations are A&B, A&C, A&D, A&E, B&C, B&D, B&E, C&D, C&E and D&E, the number of which can be calculated by the mathematical expression 5!/(2!*3!)=(5*4)/(2*1)=10. But we don't need 10 basic humbucking circuits to do that, since all the combinations can be produced from linear combinations of pairs of "adjacent" sensors in the sequence, A, B, C, D and E, just by setting the gains. Let the first "adjacent" pairs be A&B and C&D, feeding a first line of humbucking pair amplifiers. A second intertwined line of connecting amplifiers connect the "adjacent" pairs B&C and D&E, with E connected as shown for C in FIG. 10.

Note Claim 1.*c*. It shows how a combination of J>1 matched electromagnetic sensors can be combined a combination of K>1 matched piezoelectric sensors, and so on. These are not in the figures, but follow naturally from the basic design of the invention. A piano could easily use both types of sensors.

FIG. 6 illustrates Claim 2.

SW1 in FIG. 23 illustrates Claim 3.

SW2 in FIG. 23 illustrates Claim 4.

FIG. 25 illustrates Claim 5.

Claim 6 sets up the definitions and embodiments of the variable gains in circuits illustrated in FIGS. 6 to 20. The Claims dependent upon Claim 6 cover these embodiments. Without these embodiments, the invention in Claim 1 cannot fulfill its promise. The term "scaled" means that all the gains can be multiplied or divided by a single number, or factor, so that the sum of squares of the gains equals 1. With orthogonal functions controlling the gains, this will tend to set a path through the a gain space of dimension J−1, which will tend to equalize the output amplitude. But the output amplitude will necessarily not be equal at all points on the path because of phase cancellations between humbucking pair signals. This can be addressed with a micro-controller or -processor primarily by using Fast Fourier or other suitable transforms of the basic humbucking pair signals to predict the output amplitudes along the path and correct it to equal amplitudes by adjusting the final gain.

One can note that within these definitions and Claims, this system of continuous variable gains can simulate any mechanically switched system of humbucking pair signals merely by changing the gain functions from continuous functions into functions with step changes and a limited set of discrete values. Further, the discrete values can be scaled so that the final output amplitudes are equalized, regardless of any phase cancellations. This might also simplify mechanical or digital programming and satisfy a desire to restrict the output to tones to those that may be considered the most "useful", according to preference of individual musicians, and in the order they prefer. This is not "new material" but a logical implication of the existing structure disclosed in this invention. From the user's viewpoint, it is functionally the same as ordering a set of particular tones, that are otherwise part of a continuous set, in the user's favorite order.

For example, in U.S. Pat. No. 10,810,987, one could order the switched tones of one mode, ST (standard Stratocaster tones) or HB (humbucking), but not the other. In this invention, both sets of switched tones can be produced from the same three pickups, using the mode switch, SW1 in FIG. 23, to short out one of the humbucking pair sensors, in any order one prefers, including mixing modes in the musician's preferred order.

The various embodiments are necessary because not all manufacturers will have the same level of technical capability. One may be able to design and make surface-mount, printed-circuit micro-controller systems, up to the level of a smart phone, where another can only make electro-mechanical systems, and will be satisfied with that level, perhaps marketing products as "hand-wired".

Note that the physical controls for the variable gains preferably embody and approximate orthogonal functions. While the mathematical functions themselves cannot be patented, the embodiments can, whether as electro-mechanical potentiometers with particular resistance profiles (tapers) and connections, or as linear digital-analog solid state potentiometers with particular control algorithms in place of physical resistance profiles. In other words, in the opinion of this Applicant, even if the mathematical functions embodied in Listing 1 cannot be patented to keep anyone else from using them without license, especially in other applications, this embodiment in this application can be.

Listing 1 illustrates the preferred algorithm. It is non-obvious and novel in part that it specifically targets any micro-power micro-controller which does not have orthogonal sine or cosine functions in its math processor, but only plus, minus, times, divide and square root. The algorithm approximates sine and cosine to several levels of accuracy, using only those functions, and thus enables the calculation of them for both variable gains and for the calculation of Fast Fourier Transforms to analyze the sensor signals. It does this for the eventual purpose of ordering the tones produced from "warm" to "bright" and back (the method and means of which is not yet fully defined), as a means of conveniently arranging the continuous tone outputs in a musically recognizable order which hopefully will be less confusing and more useful to the user/musician/guitarist. In using a micro-power uC, it has the added advantage running for longer times on smaller batteries inside the instrument. The different levels of accuracy in Listing 1 allow tonal resolution or selection to be traded off with computation time.

Also, for J number of matched sensors/pickups, there are J−1 number of humbucking pairs, and the sum of squares gain equation reduces the number of necessary gain controls to J−2. In the case of a 3-coil Stratocaster (™Fender) guitar, the gains for each humbucking pair can be sine and cosine pots on one shaft, or pseudo-sine-cosine pots on one shaft, or multi-gang pots on a single shaft that emulate a couple of orthogonal functions, or digital pots with programmed orthogonal functions.

[FIGS. 6-11 illustrate Claim 7, in which the sum of squares equation is simulated by electro-mechanical pots with sine-cosine tapers. As FIG. 11 illustrates, for this to work for J>2 the simulated functions have to be nested, with a sine or cosine pot multiplying the sum of a previous sum of two squares, to keep all the gains less than or equal to one. There is more than one nesting strategy, which Claim 7 does not specify. Math 10 shows one nesting strategy, which is used in FIG. 11. The first some of cosine-squared plus sine-squared has the trig identity of one, which then multiplied by an intermediate cosine-squared gain and added to another sine-squared gain also adds to one, and so on.

Another nesting strategy for J>4, could be to arrange the amplifiers and gains to handle two humbucking pair signals (i.e., A−B and B−C) with their own sine-cosine gains, two others (i.e., C−D and D−E) with their own sine-cosine gains, and so on, then multiply the sums of those signals by additional sine-cosine coefficients, i.e., $\{(A-B)\cos(\theta_1)+(B-C)\sin(\theta_1)\}\cos(\theta_3)+\{(C-D)\cos(\theta_2)+(D-E)\sin(\theta_2)\}\sin(\theta_3)$. Nor do the simulated functions have to be sine and cosine; they can be any set of orthogonal functions. Sine and Cosine are just preferred for moving through the gain control N-space, as they tend to place successive points in that space equally apart.

Note that only half of either sine or cosine function is needed, as shown in FIG. 9. As noted in the Specification, the remaining parts of the sine-cosine functions develop only the inverted signals, which in a linear system are not audibly different. This is useful because 360-deg sine-cosine pots are more expensive. Sine-cosine tapers for 270-deg pots are not inexpensive, but this will be addressed in later Claims.

FIGS. 12-14 illustrate Claim 8, wherein a three-gang linear pot with a resistor (Pg and $R_B$ in FIG. 12) produce roughly orthogonal pseudo-sine functions (FIG. 13), which describes a roughly circular path through the gain space (FIG. 14). Because the ratio of V1/Vc is less than one, The gain, G, of Buff1 in FIG. 12 must be its inverse for the sum of squares to work. The physical simulation of orthogonal functions will never be perfect it just has to be good enough to work. The resulting variations in output amplitude due to imperfect simulations of orthogonal functions will most likely be swamped by the variations due to canceling of parts of different sensor signals due to phase differences.

FIGS. 15-20 illustrate Claims 9-10. One cannot quite imagine a clear and concise claim language one could use if one can not refer to Maths 13-17 and Listing 1 to describe what functions the physical embodiments simulate. Please bear in mind that no one before has solved the problem of duplicate and limited tone sets often inherent to electro-mechanical switching circuits. This invention not only produces all the possible switched humbucking tones, it produces all the continuous tones in between.

Here, the algorithm in Math 14-17 and Listing 1 calculates an approximation of sine to several levels of accuracy, then takes advantage of the trig identity $\cos^2+\sin^2=1$ to calculate cosine using the square root function. Unlike infinite series approximations of sine and cosine, in which the error grows as the independent variable moves away from the definition point, and with the increasing truncation of the series, this algorithm can be tuned through the coefficients, $b_i$, in Math 17 to some minimum level of maximum error, according to some measure of error like mean-absolute-error, mean-squared-error or rms error, across the whole range of one-half cycle. If they are pre-calculated by the processor at the highest level of accuracy for a look-up table, then the calculation of the gains could be even faster than for a processor with sine and cosine functions.

FIG. 21 illustrates Claim 11. It looks unwieldy, but this part of the invention extends art already Claimed in U.S. Pat. No. 10,217,450, FIGS. 20 and Ser. No. 10,380,986, FIGS. 14, 15 & 17. It's just the architecture and some support circuits, not the detailed programming, because age and medication have deprived the inventor of sure command of those skills. That will have to be done by others. The functions of the intended programming are described in the claim, not unlike the stand-alone flow charts, without programming code, as allowed in other patents.

In this invention, the signal path stays entirely analog, from the sensors and optional tone controls in FIG. 25, to the manual volume and tone and possibly distortion controls in the last output stage (ANALOG SIGNAL COND in FIG. 21). The digital controls mean only to simplify the user interface in the substantially confusing N-space used to control the variable gains. The ideal is to navigate that space, continuously and monotonically, from bright to warm tones, with the GAIN SET and SUM AMP functions taking care of the output variations due to signal phase cancellations between the humbucking pair tones. The programming for that will by no means be easy, and subject to a lot of future research, considering how subjective "tone" is. That's nothing one could answer at this time nor in this patent application. Here, only an efficient system framework is provided.

Claim 12 has been added to address an Examiner's Objection to "informal language" in Claim 1, expressing a preference for sensors with just 2 electrical output leads.

Claim 13 has been added to emphasize the function of the final stage gain setting in the GAIN SET of FIG. 21 and the digital pot, $P_{DF}$, in FIG. 23.

The invention claimed is:

1. A humbucking circuit containing J>1 number of matched vibration sensors, having one or more basic building block circuits, comprised of:

a. a basic building block circuit, comprised of:

i. a pair of vibration sensors, which are functionally identical in their response to an unwanted external interfering signal, called hum, which appears on two output terminals on each of said vibration sensors, equally in phase and magnitude, superimposed upon the desired vibration signal, said sensors having different responses to a desired vibration signal, due either to differences in mounting said sensors on an instrument or machine, or to differences in the construction or function of each of said sensor with respect to said desired vibration signal, with a common point connection between said pair of sensors of a first output terminal from each of said sensors, such that the phase of said hum is the same on both first terminals; and ii. a second of said output terminals on each sensor, both second terminals having the same phase and magnitude of said hum, but opposing the phase of said hum on said first output terminals, one of said second output terminals connected to the plus input of a differential amplifier and the other of said second output terminals connected to the minus input of said differential amplifier, with the output of said differential amplifier being modified by a variable gain, such that said hum is cancelled at the output of said differential amplifier, and the remaining vibrational signal being called a humbucking pair signal, which is modified by said variable gain; and b. a first combination of said building block circuits, wherein for J number of said matched vibration sensors there are J−1 number of said basic building block circuits, interconnected through said second output terminals of said matched vibration sensors, such that the overall circuit is organized into an ordered sequence of said matched vibration sensors, and J−1 of said differential amplifiers obtain their plus and minus inputs from said second output terminals of successive overlapping pairs of said matched vibration sensors, such that for an example sequence of said matched vibration sensors, A, B, C and D, said differential amplifiers have humbucking pair outputs of (A−B), (B−C) and (C−D), each modified by said variable gains and, if J>2, an additional circuit performs a linear summation of all such humbucking pair signals; and c. wherein any additional combination of said building block circuits, additional to a first group of said building block circuits, with a set of vibrational sensors always numbering greater than 1 within each additional group, which are matched within said additional group with respect to said hum or other external interference, but of types dissimilar to said first and other of said group or groups of building block circuits, shall not be interconnected with said ordered sequence of pairs of said first or other group with any harm to humbucking, but instead, all said groups of building block circuits, each with different sensors, are summed together linearly only in a final signal output.

2. The invention as recited in claim 1, wherein said differential amplifiers all have their outputs connected through variable attenuators, or potentiometers, to one electronic buffer each, said buffers connecting through summing resistors to a summing amplifier, which have either a single-ended or differential output, such that said differential amplifiers, buffers and summer perform the physical electronic function of making said linear combination of said humbucking pair signals.

3. The invention as recited in claim 1, wherein either or both of the inputs of any of said differential amplifiers in a group of said building block circuits of similar sensors can be shorted by a switch to the sensor common connection point for that group, including by electromechanical or solid-state digital switches.

4. The invention as recited in claim 1, wherein either output of any of said differential amplifiers may be diverted by a switch to an analog-to-digital converter, for the purpose of sampling by a digital processing system.

5. The invention as recited in claim 1, wherein any of said sensors may have individual tone modification circuits, consisting of a choice of one or more tone capacitors in series with a variable resistance, with or without a switch to disable said tone modification circuit without disabling the output of said sensor.

6. The invention as recited in claim 1, wherein the embodiments ensure that when said variable gains associated with said differential amplifiers in said building block circuits are equally scaled to a value of one or less, such that the sum of the squares of said scaled gains is approximately equal to one over the range of the gains, using approximately orthogonal functional relationships, for the purpose of changing the fundamental tone of the system output signal, due to the relative contributions of each said sensor, in a continuous manner without significantly changing the amplitude of said output signal, ignoring the effects of phase cancellations between said humbucking pair signals, wherein the functions for changing said variable gains are based upon mutually orthogonal functions.

7. The embodiment as recited in claim 6, wherein said variable gains are embodied in electro-mechanical potentiometer gangs with sine-cosine tapers, with separate sine and cosine taper gangs assigned to humbucking pair signals that are adjacent in the circuit, and the signals are combined in the circuit by summing said pairs of sine- and cosine-modified humbucking pairs of sensor signals, then nested, as required by the number of said humbucking building blocks, into further sine-cosine gain stages so that said sum of squares of all the signals is still approximately constant and scaled to one.

8. The embodiment as recited in claim 6, wherein the necessary orthogonal functions to produce a sum of squares of signals approximately equal to one are simulated by a 3-gang linear potentiometer, a resistor and a buffer of gain greater than one, such that:

a. one gang of said linear pot is used for the simulation of a pseudo-sine half function, with its ends connected to the differential outputs of one of said differential humbucking pair amplifiers, and the wiper producing the signal output; and b. said resistor is connected to one output of another of said differential humbucking pair amplifiers, in series with the remaining two gangs of said linear pot, to form a voltage divider which simulates a pseudo-cosine function, the wipers of said gangs being connected together and the ends of said gangs being connected to said resistor and the signal ground, such that the clockwise end of one gang is connected to the counter-clockwise end of the other, forming two connections between the ends of said gangs, and a first of said clockwise-counter-clockwise connections is connected to the end of said resistor not connected to said differential amplifier output, and the second of said clockwise-counter-clockwise connections is connected to said signal ground, with the connection between said resistor and said gangs being connected to said buffer amplifier; and c. said buffer amplifier has a gain that is the inverse of the voltage-divider ratio of the voltage at the pot-connected end of said resistor, divided by the voltage of the end of said resistor connected to said differential amplifier.

9. The embodiment as recited in claim 6, wherein said variable gains are determined by digitally-controlled linear pots, using some form of digital processor which has sine and cosine functions in its Math Processing Unit, which a program uses to fit the effective tapers of said digitally-controlled linear pots to set the sum of the squares of said scaled gains is approximately equal to one over the range of the gains.

10. The embodiment as recited in claim 6, wherein said variable gains associated with said differential amplifiers are determined by digitally-controlled linear pots to three different levels in increasing accuracy for increasingly time-consuming computations, using a programmable digital computing device without sine or cosine math functions, which has add, subtract, multiply, divide and square-root math functions, on a scaled independent variable, x, in the range of zero to one, and other variables derived from x, which calculates a pseudo-sine from polynomials of the independent variable and a pseudo-cosine from the square root of the difference between one and the square of the pseudo-sine function, the three levels comprising:

a. a first and lowest level of accuracy and computation effort in said programmable digital computing device, based upon a polynomial of the powers of zero and two of the difference between x and the constant one-half; and b. a second level of accuracy and computational effort, based upon the powers of zero, two and four of the difference between x and the constant one-half; and c. A third and highest level of accuracy and computational effort, accomplished by adding a correction to said second level of accuracy and computational effort, which correction uses an independent variable, xm2, which is the modulo one-half of a variable, xm, which is the modulo one of said variable x, which correction is a third-order polynomial of the square of the quantity xm2 minus one-quarter.

11. The invention as recited in claim 1, wherein the circuits and variable gains are controlled by a programmable digital computing device, including a micro-controller, a micro-processor, a micro-computer or a digital signal processor, which includes at least the following:

a. read-only and random access memory, suitable for programs and variables, and b. a control section for following programmed instructions, and c. a section for computing mathematical operations, including binary, integer, fixed point and floating point operations, with at least add, subtract, multiply, divide and square root functions, and d. digital binary input-output control lines, suitable for controlling digital peripherals, and e. at least one analog-to-digital converter, suitable for taking rapid and simultaneous or near-simultaneous samples of two or more sensor voltage signals in at least the audio frequency range, and f. at least one digital-to-analog converter, suitable for presenting the inverse spectral transform, of a computed linear combination of spectral transforms, to an audio output for user information, and g. timer functions, and h. suitable functions for a Real-Time Operating System, and i. at least one serial input-output port, and j. installed programming such that at least:

i. humbucking pairs of said vibration sensors are, when excited in a standard fashion, including strumming one or more strings at once, or strumming one or more strings in a chord, or strumming all strings sequentially, be sampled near-simultaneously, at a rate rapid enough for the construction of spectral and tonal analyses, having forward and reverse transforms, over the working range of the sensors, in both frequency and amplitude, and ii. the mean or sum of the amplitudes of such spectra are be summed over the frequency range to determine the inherent signal strength of said humbucking pairs, and iii. said signal strength be used to equalize the outputs of various linear combinations of the signals of said humbucking pairs, and iv. said spectra be modified by psychoacoustic functions to assess the audible tones of various linear combinations of the signals of said humbucking pairs, and v. the components of said spectra be used to compute the means and moments of said spectra, and vi. said calculations from said spectra be used to order the tones of said linear combinations of said signals of said humbucking pairs into near-monotonic gradations from bright to warm, for the purpose of allowing user controls to shift from bright to warm tones and back, without the user ever needing to know which signals were used in what combinations, and vii. the order of such gradations be presented to the user for approval or modification, including the use of audible representations of tones obtained from inverse spectral transformations and fed to the instrument output via a digital-to-analog converter feeding into the final output amplifier of said system, and viii. allowing external devices to connect to said system for the purposes of updating and re-programming, testing and control of said system; and ix. includes drivers for all input and output peripherals.

12. The invention as recited in claim 1, wherein said matched sensors have only two electrical output terminals.

13. The invention as recited in claim 6, wherein the amplitude variations due to phase cancellations between said humbucking pair signals are corrected by the gain of the final output or summation stage.

14. The invention as recited in claim 11, wherein said section for computing mathematical operations of said programmable digital computing device includes sine and cosine functions.

15. The invention as recited in claim 11, wherein said section for computing mathematical operations of said programmable digital computing device includes Fast Fourier transforms and inverse functions.

* * * * *